United States Patent [19]

Bell

[11] Patent Number: 4,846,774

[45] Date of Patent: Jul. 11, 1989

[54] ROTARY DIE CUTTING AND LAMINATING PROCESS AND MACHINE

[75] Inventor: Jerry L. Bell, Rochester Hills, Mich.

[73] Assignee: Bernal Rotary Systems, Inc., Troy, Mich.

[21] Appl. No.: 148,771

[22] Filed: Jan. 26, 1988

[51] Int. Cl.[4] ..... B31B 1/84

[52] U.S. Cl. ..... 493/87; 493/102; 493/344; 413/9; 413/12; 413/8; 413/59; 413/66; 83/152

[58] Field of Search ..... 413/9, 12, 59, 63, 64, 413/66, 8; 493/67, 87, 102, 108, 152, 344, 345, 379, 380; 83/100, 24, 46, 152, 154, 346

[56] References Cited

U.S. PATENT DOCUMENTS

| | | | |
|---|---|---|---|
| 3,380,327 | 4/1968 | Stemmler | 83/100 |
| 3,550,479 | 12/1970 | Pfaff, Jr. | 219/69 M |
| 3,796,851 | 3/1974 | Pfaff, Jr. | 219/69 M |
| 3,911,805 | 10/1975 | Baird | 83/152 |
| 3,957,570 | 5/1976 | Helm | 493/344 |
| 4,306,849 | 12/1981 | Cress et al. | 83/152 |

FOREIGN PATENT DOCUMENTS

| | | | |
|---|---|---|---|
| 0088925 | 6/1982 | Japan | 413/12 |

*Primary Examiner*—Robert P. Olszewski
*Assistant Examiner*—Robert Showalter
*Attorney, Agent, or Firm*—Barnes, Kisselle, Raisch, Choate, Whittemore & Hulbert

[57] ABSTRACT

A machine and process for making container lid assemblies with a flexible membrane with a pull tab adhesively secured to a rigid ring so that when desired the membrane can be peeled off and removed from the ring to provide access to the container. Individual membranes are cut and separated from a web by rotating dies and individually transferred, accelerated and applied by a rotating anvil cylinder and transfer roller to individual rings which have been preheated sufficiently to activate an adhesive to adhere the membrane about its periphery to the ring. The rings are heated by an induction coil and a downstacker deposits heated rings on a moving conveyor belt which conveys them under the transfer roller where they are urged into firm engagement with a membrane by a resilient applicator pad on the transfer roller and an underlying support roller. If a ring has not been heated sufficiently to insure proper adhesion of its associated membrane, the membrane is released and removed from the transfer roller to avoid producing lid assemblies with a defective seal. Downstream from the transfer roller, lid assemblies are inspected and defective lid assemblies are rejected. Lid assemblies are cooled relatively quickly by fans and then they are ready by packaging, shipment and use.

36 Claims, 12 Drawing Sheets

FIG.5
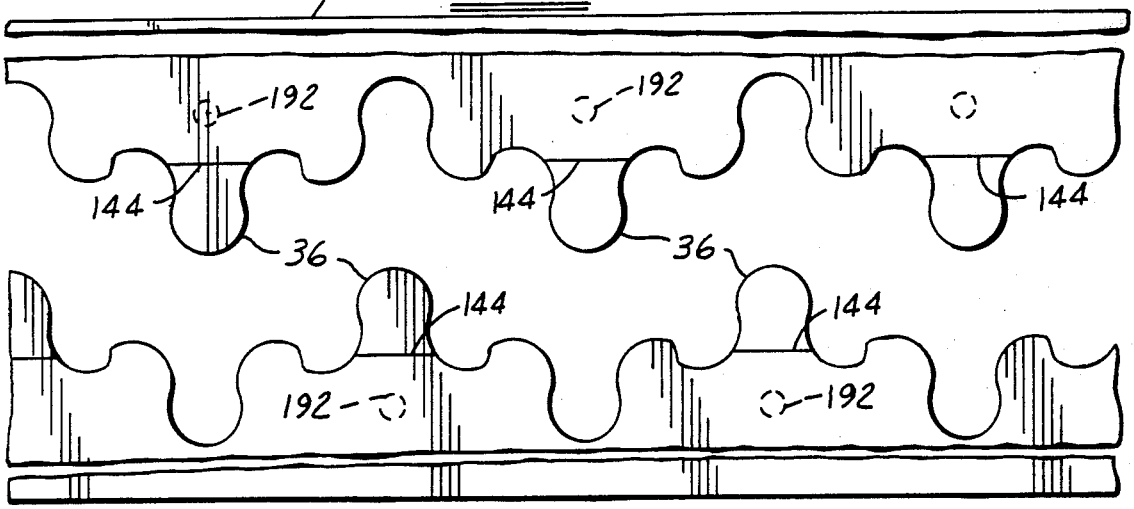
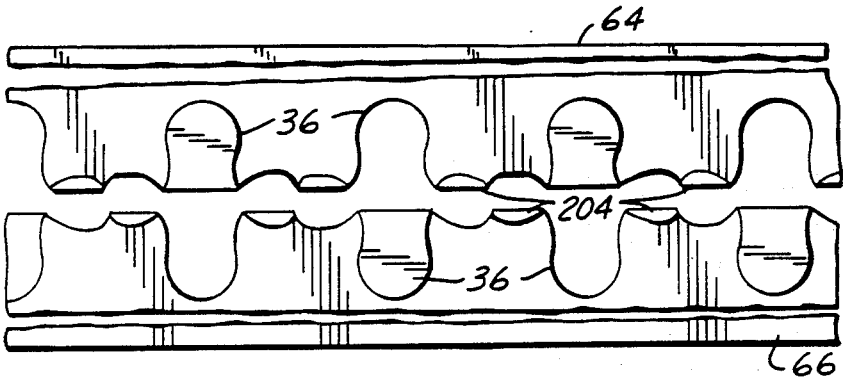
FIG.6
FIG.7
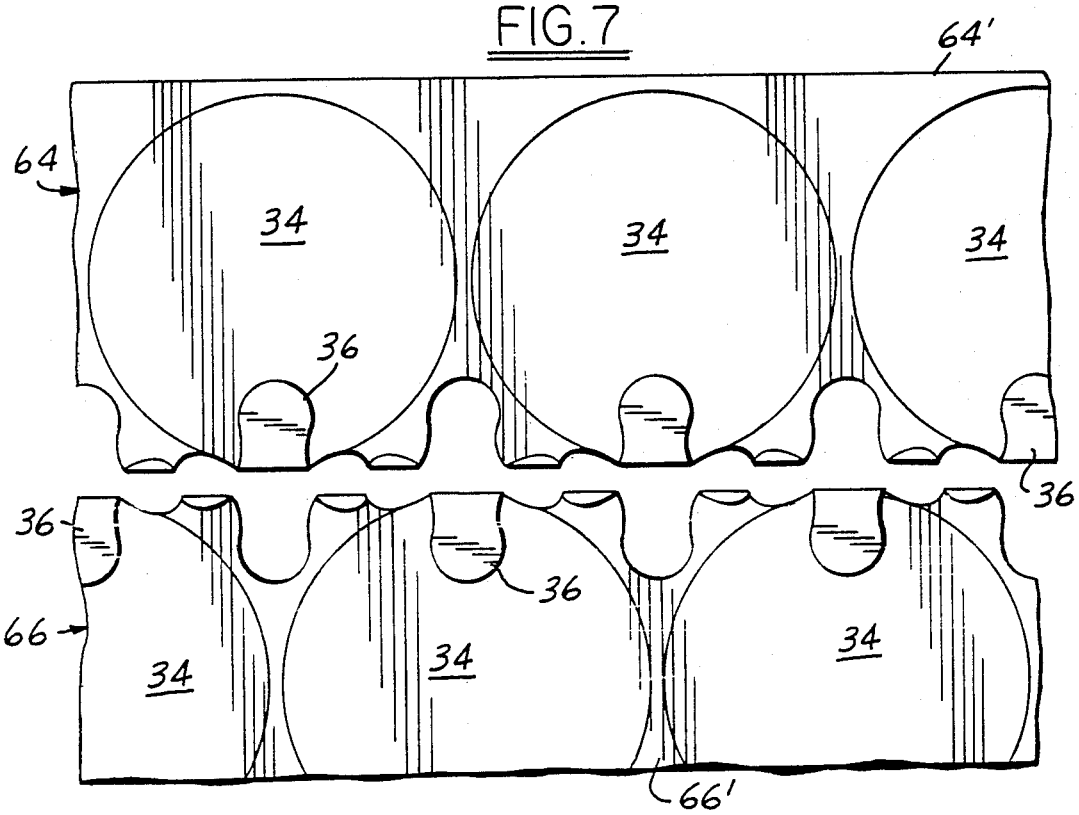

FIG. 11
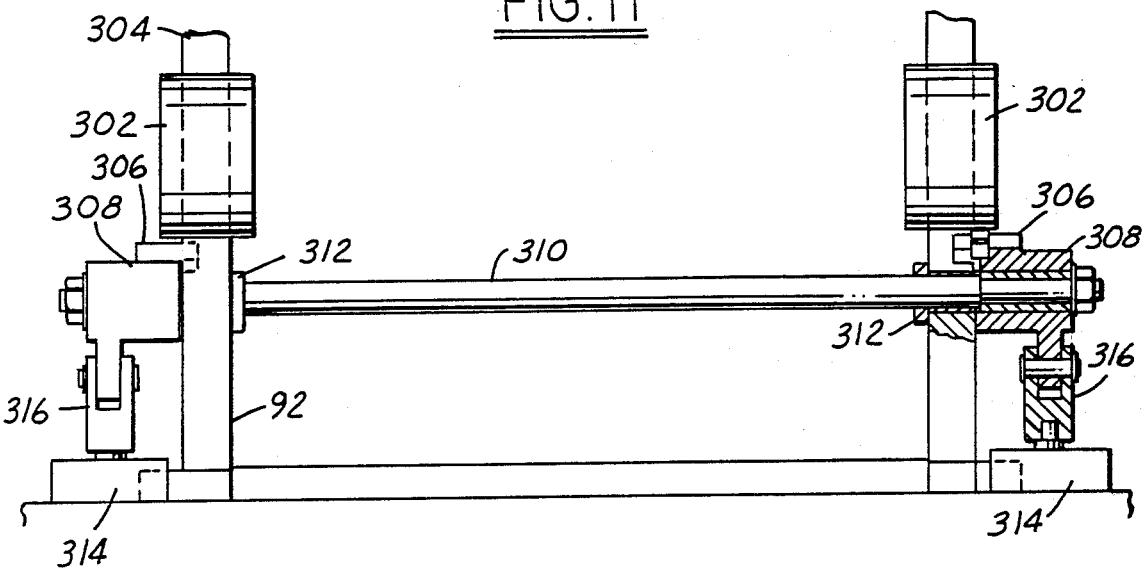
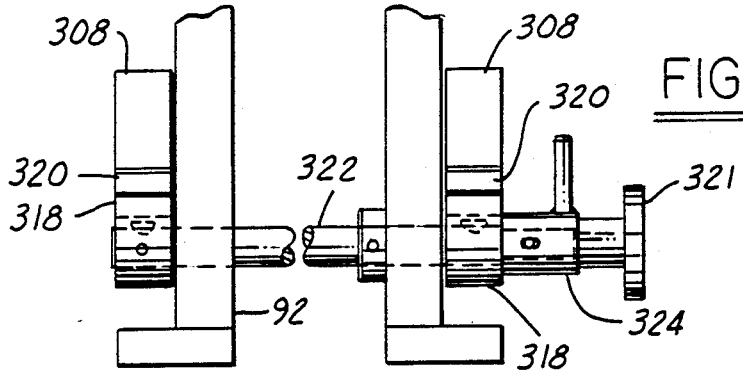
FIG. 12
FIG. 13
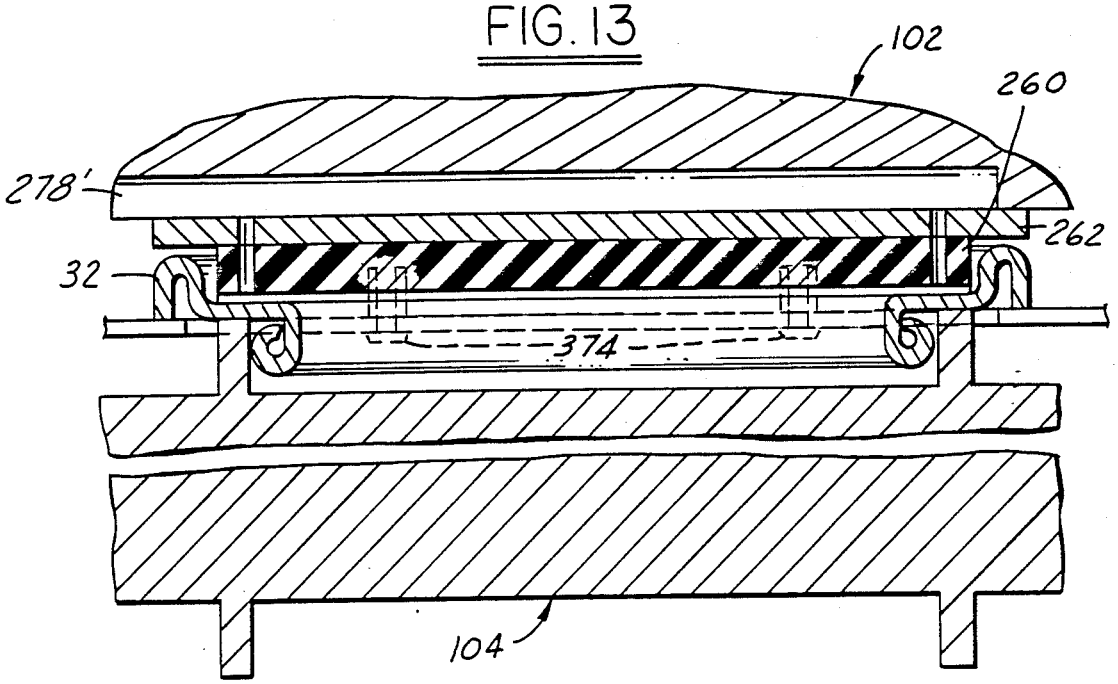

FIG. 16
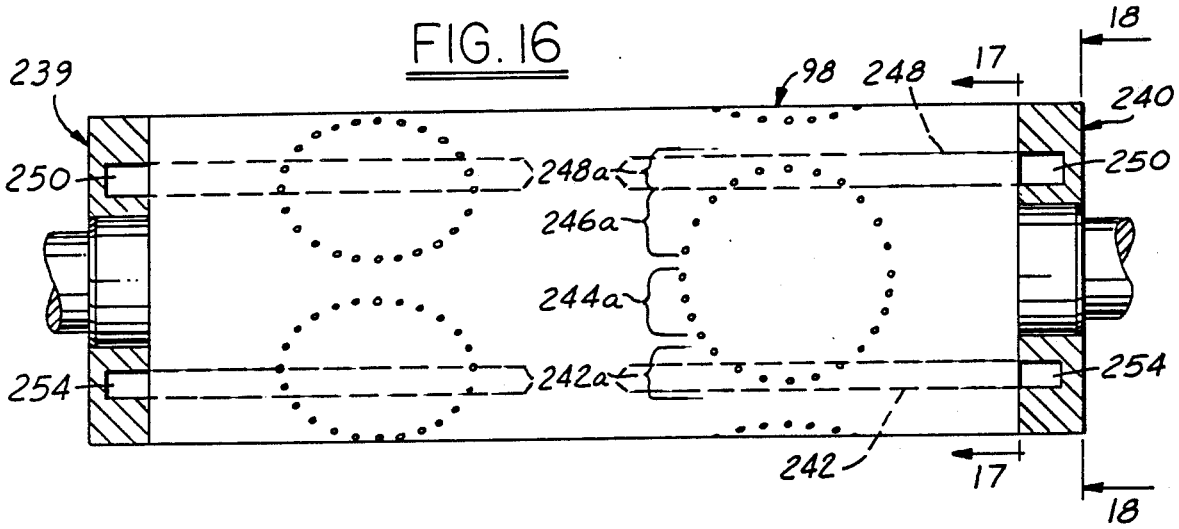
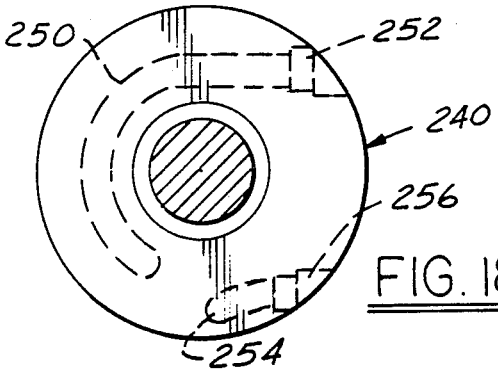
FIG. 18
FIG. 17
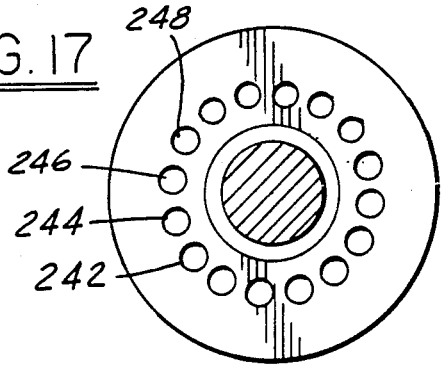
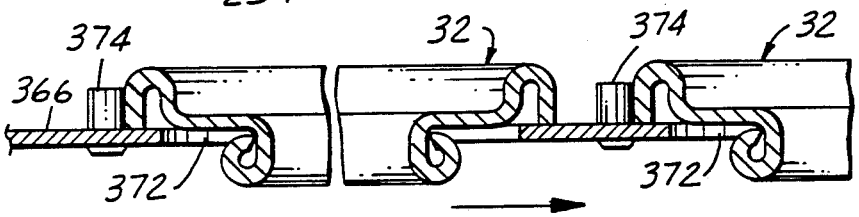
FIG. 14
FIG. 15
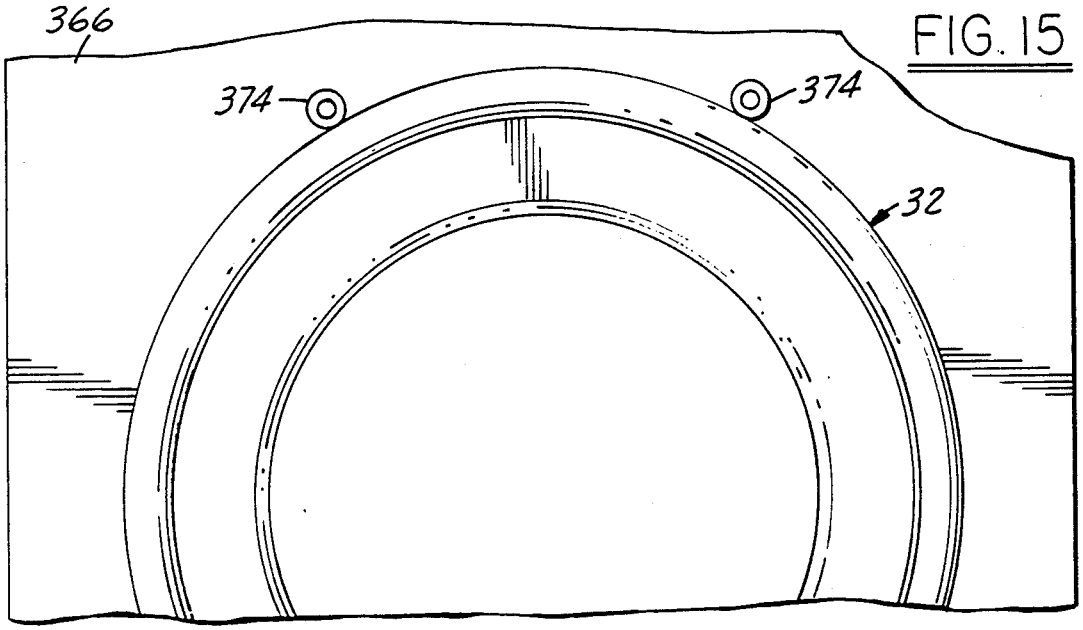

ROTARY DIE CUTTING AND LAMINATING PROCESS AND MACHINE

FIELD

This invention relates to rotary die cutting and more particularly to a machine and process for continuously cutting individual membranes from a continuous web of flexible material and applying and adhering each membrane to a substrate.

BACKGROUND OF THE INVENTION

Rotary dies are previously known for cutting blanks from a continuous web of flexible material passing between them. Rotary dies having one cylinder with a plain cylindrical surface acting as an anvil for cutting elements carried by and projecting radially outwardly of another cylinder and having a sharp knife edge with a V-shape cross section are disclosed in U.S. Pat. Nos. 3,550,479 and 3,796,851. These patents also disclose a method and apparatus for producing these cutting elements as a homogeneously integral part of the cylinder.

In making envelopes or jackets for floppy disks, it is known to use a plain cylindrical transfer roller with vacuum ports therein to transfer cut blanks of fabric in spaced apart relationship onto a second web of a continuous plastic film, and subsequently to tack them together by heating and forcing small portions of the plastic film and fabric together. The cut blanks are stripped from the transfer roller and initially retained on the web of plastic film prior to heat tacking by an electrostatic charge applied to the web of plastic film.

SUMMARY OF THE INVENTION

In accordance with this invention and in a continuous process, individual membranes are completely cut from a web of flexible material by rotary dies, transferred, accelerated and applied by rollers to a preheated substrate which can be a continuous flexible web or preferably is a plurality of discreet, individual and rigid members. The flexible membrane is applied to the heated substrate by a transfer roller with ports and vacuum and pressure manifolds which facilitate pickup and release of individual membranes on resilient pads each of which firmly applies a membrane to a substrate without wrinkling the membrane. To prevent the jamming of improperly aligned substrates from damaging the transfer roller, the substrates are urged into engagement with the transfer roll by a yieldably biased support roller. Preferably, the substrates are preheated and deposited by a stacker and heater device in spaced apart relationship on a continuously moving conveyor which delivers the substrates to the transfer roller.

If a substrate is not preheated to a specified minimum temperature needed to produce adequate adhesion of a membrane, preferably the membrane is removed from the transfer roller and not applied to the substate thereby avoiding a defective assembly and, if desired, permitting subsequent recycling of the substrate. Preferably, the assembly of a membrane to a substrate is automatically inspected, defects rejected, and acceptable assemblies air cooled to an ambient temperature.

OBJECTS, FEATURES, AND ADVANTAGES OF THIS INVENTION

Objects, features and advantages of this invention are to provide a machine and process for cutting flexible membranes and applying and adhering them to a substrate which operates at a high speed and rate of production, produces little scrap, applies and adheres membranes to preheated substrates without wrinkles in and distortion of the membranes, produces complete assemblies, eliminates damage due to jam up of substrates, automatically detects and rejects defective assemblies, avoids producing defective assemblies by applying membranes to insufficiently preheated substrates, and is extremely rugged, durable, dependable, reliable and of relatively simplified design and economical manufacture assembly.

BRIEF DESCRIPTION OF THE DRAWINGS

These and other objects, features and advantages of this invention will be apparent from the following detailed description, and accompanying drawings in which:

FIG. 5 is a fragmentary and exploded plan view of the web of FIG. 3 after it has been longitudinally severed and laterally separated into two strips by the machine;

FIG. 6 is a fragmentary plan view of the strips of FIG. 5 after the tabs have been folded over by the machine;

FIG. 7 is a fragmentary plan view of the strips of FIGS. 6 illustrating individual membranes cut from the strips by the machine;

FIGS. 11 and 12 are fragmentary sectional views taken on line 11—11 and 12—12 respectively of FIG. 9 and showing a carrier which yieldably mounts the support roller;

FIG. 13 is a fragmentary sectional view of the transfer and support roller illustrating the application of a membrane to a ring;

FIG. 14 is a fragmentary longitudinal sectional view of a conveyor belt of the machine illustrating two adjacent rings received thereon;

FIG. 15 is a fragmentary plan view of a conveyor belt of the machine ring received thereon;

FIG. 16 is a fragmentary side view with portions broken away of the anvil roller and manifolds of the machine of FIG. 3;

FIG. 17 is an end view of the anvil roller taken generally on lines 17—17 in FIG. 16;

FIG. 18 is an end view of one of the manifolds for the anvil roller of FIG. 16;

DETAILED DESCRIPTION

The process and machine of this invention can cut blanks from a web of flexible material and apply and adhere the blanks to a wide variety of individual substrates or another continuous web. By way of illustration, the process and machine are described in connection with making a can lid assembly with a peel back or removable top.

Figure 1:
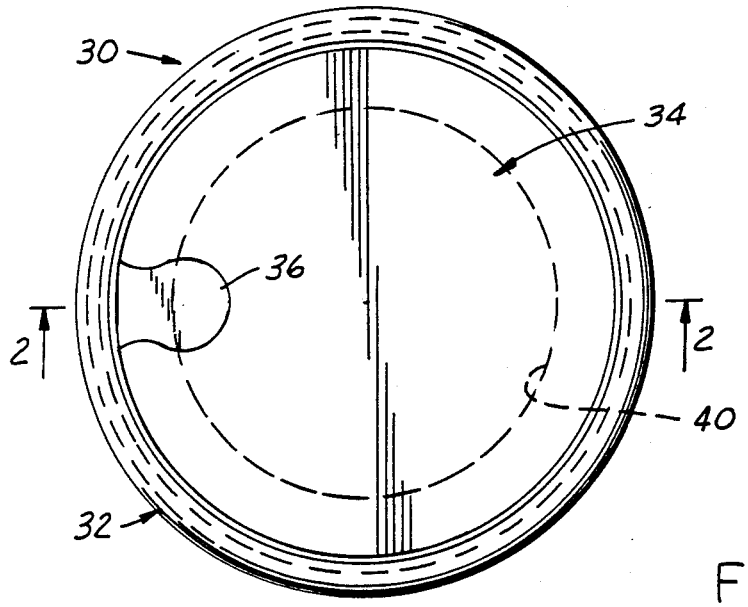
FIG. 1 is a plan view of a can lid assembly with a removable membrane produced and assembled to a ring of the lid by a process and apparatus of this invention.
Figure 2:
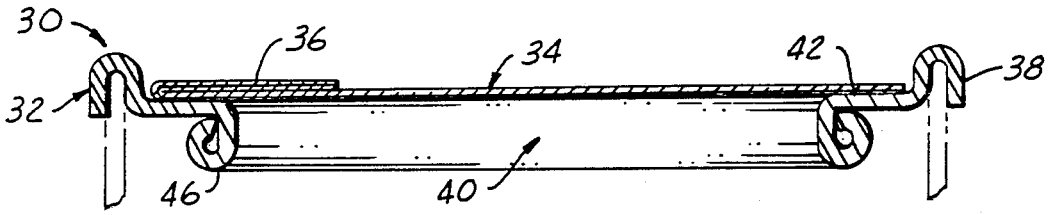
FIG. 2 is a sectional view of the can lid taken generally on line 2—2 of FIG. 1.

FIGS. 1 & 2 illustrate a can lid assembly 30 with a rigid ring 32 and a removable membrane 34 with a pull tab 36 produced by the process and machine of this invention.

Preferably, the ring 32 has an outer rim 38 which can be secured to a side wall 40 of a container (not shown), such as by rolling the rim to provide frictional engagement with the wall or utilizing a suitable adhesive. The ring 32 has an integral annular and circumferentially continuous ledge or shelf 42 to which the membrane 34 is attached by a suitable adhesive, a central through opening 44 and a rolled inner edge 46 reinforcing the ring. Preferably, the ring is formed of sheet metal, such as tin plate steel or aluminum.

Preferably, the flexible membrane 34 is a laminate or composite of an aluminum foil adhered by a Nylon film to a Mylar sheet having a thin coating of Surlyn on its exposed face to provide a polymer adhesive for attaching the membrane to the ring. Typically, in the laminated membrane the thickness of the aluminum foil is about half of a mil, the nylon about two mils, the Mylar about two mils and the Surlyn about two mils. A suitable laminated web for making membranes is commercially available from R. J. Reynolds Printing Div. of RJR Nabisco Co. of Winston Salem, N.C. and American Can Co. of Green Bay, Wis.

The completed lid assembly must be able to withstand a pressure differential of at least 9 pounds per square inch gauge (PSIG) across the face of the lid without any leaks and have a peel force or pulling force on the tab to strip the membrane from the ring in the range of about 2 to 8 pounds and preferably about 4 to 7 pounds.

Overall Machine

Figure 4:
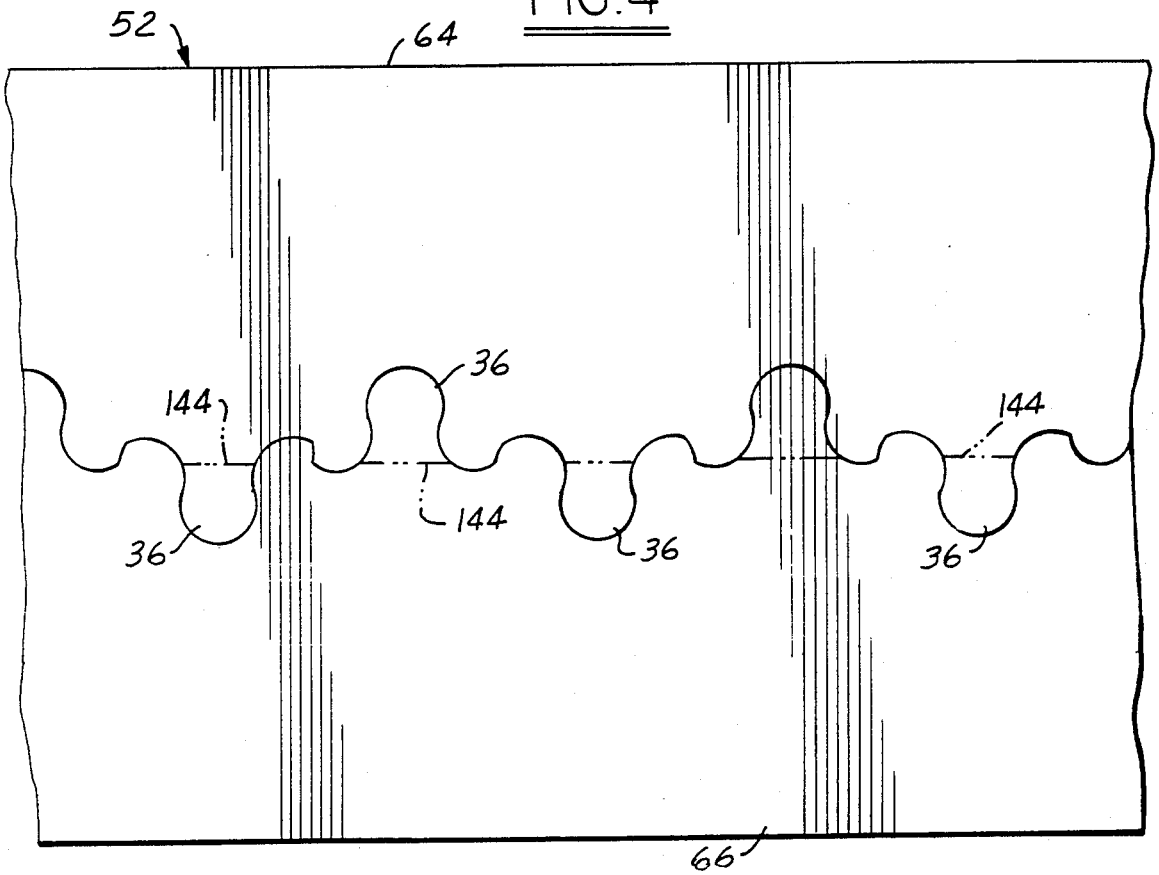
FIG. 4 is a fragmentary plan view of a web of material from which membranes are made with pull tabs cut therein by rotary dies of the machine of FIG. 3.
Figure 3:
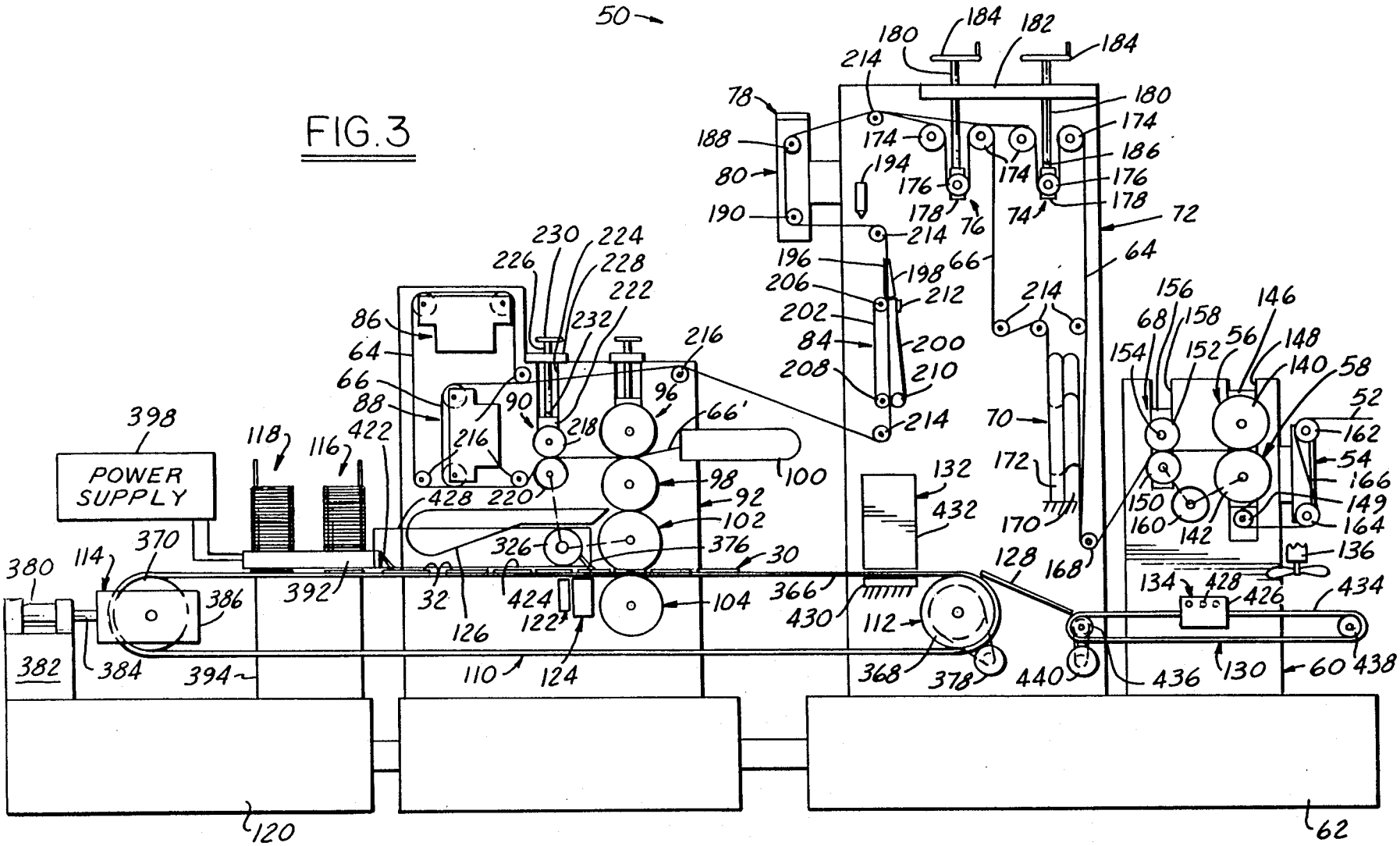
FIG. 3 is a side view of a machine embodying this invention for making can lids.

FIG. 3 illustrates a machine 50 embodying this invention and carrying out its process for cutting and forming membranes 34 from a web 52 of flexible material and applying and sealing them to rings 32 to produce complete lid assemblies. In the machine, the web is directed by a guide 54 into a rotary die 56 and anvil 58 assembly received in a die stand 60 secured to a base 62. As shown in FIG. 4, the pull tabs 36 are cut in the web 52 and it is severed longitudinally into two strips 64 and 66 by the rotary dies 56 and 58. This splitting of the web into two strips allows the membranes to be staggered and laid out on the web to minimize the amount of scrap. The web 52 is pulled through the dies by a drive 68 and the cut strips are separated and laterally spaced apart by a separator 70 carried by a stand 72. The strips pass through separate compensators 74,76 and are directed by separate guides 78 and 80 into separate folders 82,84. The tabs 36 are folded over the strips 64,66 as shown in FIG. 6, by the folders.

Figure 9:
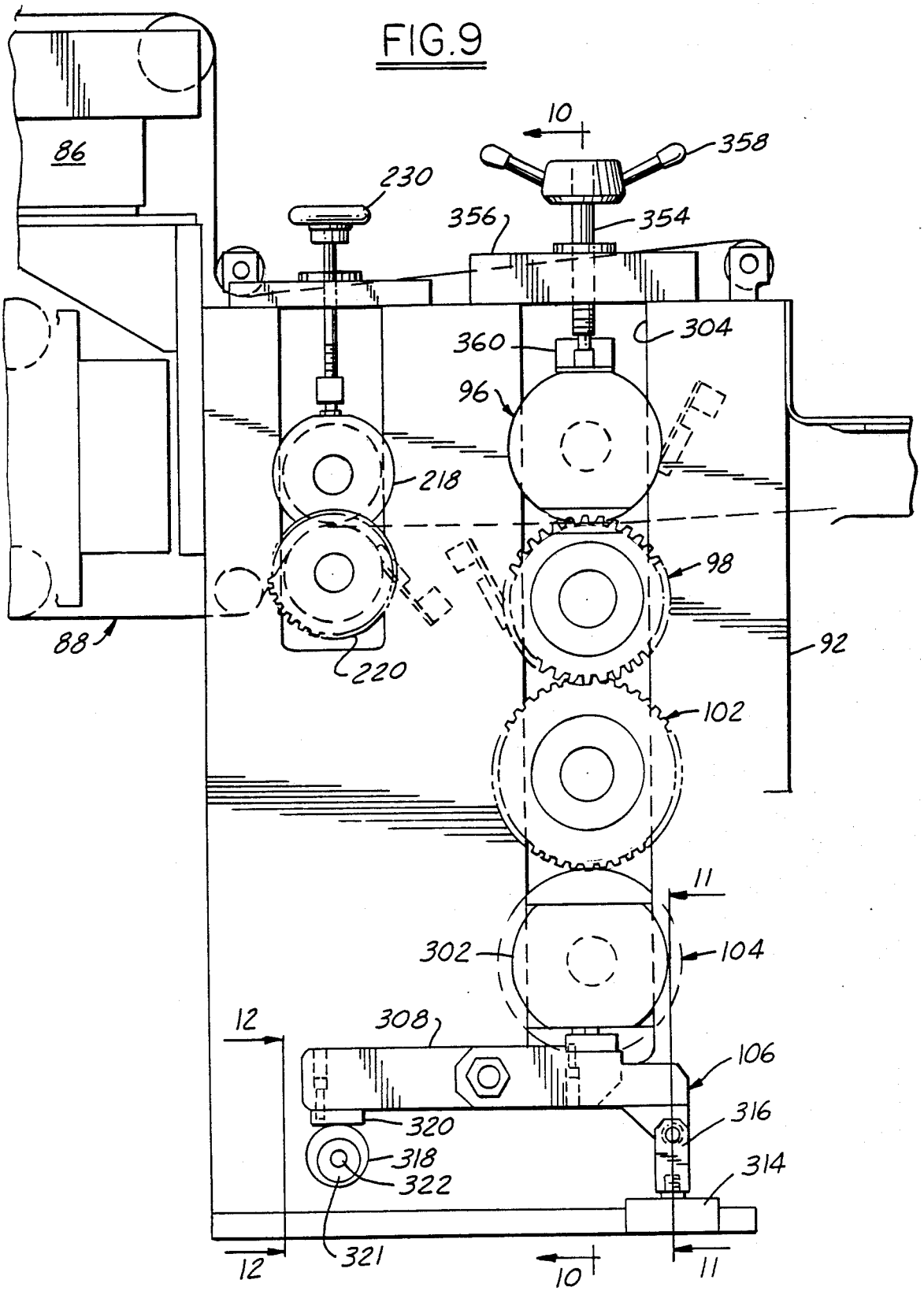
FIG. 9 is an enlarged and fragmentary side view of the machine of FIG. 3 showing the rollers in a support stand.

The strips are directed by separate automatic guides 86,88 into another drive 90 carried by another die stand 92 fixed to a base 94. The membranes 34 are cut and severed from each strip, as shown in FIG. 7, by a co-rotating die 96 and anvil 98 assembly. As the membranes are cut, they are also separated from the strips by the anvil and the stringers of scrap material 64' and 66' are removed by a vacuum chute 100. The individual membranes on the anvil are passed to a transfer roller 102 which accelerates and then applies them to heated rings 32 which are supported and urged into firm engagement with the membrane by an underlying support roller 104. The support roller is yieldably urged toward the transfer roller by a pivoted carrier assembly 106 (FIG. 9).

The rings are moved between the transfer and support roller by a pair of separate belt conveyors 108 and 110 each with drive 112 and tensioner 114 assemblies. The rings are heated and deposited on each moving belt conveyor by a separate ring downstacker and induction heater devices 116,118 mounted on a base 120. The temperature of each ring is sensed by a detector 122 or 124 nd if it is not hot enough to produce a good seal with a membrane, the membrane passes from the transfer roller 102 into a vacuum chute 126 so that it will not be applied to the ring, which, if applied, would result in a defective sealing of the membrane to the ring.

Each lid assembly 30 passes from a belt conveyor over an inclined slide 128 and onto a cooling conveyor 130. The lid assemblies are automatically inspected for the defects producing leaks of no membrane, pin holes in the membrane and any gaps or discontinuities in the sealing of the membrane to the ring by photoelectric detectors 132 which actuate a downstream deflector 134 to remove any such defective assemblies from the cooling conveyor. The lid assemblies are air-cooled to an ambient temperature by passing through streams of air produced by cooling fans 136.

Pull Tab Dies

Preferably, the pull tabs 36 are cut and the web severed longitudinally into two strips 64,66 by a pair of superimposed cutting die 140 and anvil 142 cylinders. Preferably, the die cylinder 140 has integral cutting elements extending circumferentially around the cylinder, projecting radially outward from the body of the cylinder and having a sharp knife edge with a V-shape cross section. Preferably, the anvil cylinder 142 has a plain cylindrical surface which cooperates with the knife edges to sever or cut the webs.

To provide fold lines or creases 144 for folding the tabs 36, preferably the cutting die also has a plurality of circumferentially spaced apart creasing elements, each of which extends generally circumferentially and projects radially outwardly of the body of the cylinder. These creasing elements in cross section have rounded or blunt edges rather than sharp edges, which cooperate with circumferential grooves in the anvil which have complimentary semicircular cross sections. The die and anvil cylinders are each journalled for rotation by conventional bearing assemblies (not shown), in mounting blocks 146 slidably received and releasably secured in slots 148 in the die stand 60 so that they are removably mounted therein and preferably so the location and orientation of their axes of rotation can be varied and adjusted somewhat to provide proper alignment. The construction and arrangement of these die cylinders and a preferred method and apparatus for making them is disclosed in U.S. Pat. Nos. 3,550,479 and 3,796,851, which are incorporated herein by reference, and hence will not be described in greater detail.

Web Drive and Guide

The web is pulled over an idler roller 149 and through the die and anvil cylinders by a drive roller 150 and pair of superimposed upper idler rollers 152, each separately journalled for rotation by bearings on a common carrier shaft 154. The drive and idler rollers have plain cylindrical surfaces and preferably the idler rollers are rubber coated to insure they urge the strips into firm engagement with the drive roller throughout the entire width of each strip. For the drive 68 to function properly, it is believed to be necessary to have an independent and separately journalled idler roller 152 for each strip of the web. Preferably, the shafts for the idler and drive rollers are mounted in carrier blocks 156 slidably received and releasably secured in slots 158 in the die stand 60 so they can be readily removed and replaced when necessary.

The drive roller 150 and anvil cylinder 142 are driven by a variable speed electric motor 160 which is operably connected to both the drive roller and anvil cylinder, preferably by gear trains with anti-backlash mechanisms which may be of conventional design, and hence will not be described herein. The die 140 and anvil cylinders 142 are also operably coupled together for corotation in opposite directions of rotation and at the same lineal surface speed of the knife edges and anvil surface preferably by a gear train with an anti-backlash mechanism. The drive roller is rotated in the same direction and at essentially the same lineal surface speed as the anvil cylinder.

The web guide has a pair of idler rollers 162 and 164 over which the web passes and which are journalled for rotation in a frame 166. To permit steering or shifting of the web generally laterally with respect to the die cylinder, the guide is constructed and arranged so that the orientation of the axis of rotation of at least one idler roller can be varied and adjusted relative to the axis of rotation of its other idler roller. Preferably, the guide has sensors which determine the position of the web and automatically vary and adjust the axis of the roller to provide a predetermined desired lateral alignment of the web with the cutting die. Suitable automatic web guide and steering devices are well-known, commercially available from Fife Corporation, P.O. Box 26508, Oklahoma City, Okla. 73126 under the trade name Fife E/M Guiding System, and hence will not be described in greater detail.

Strip Spreader, Compensators, Guides and Adhesive Applicators

After emerging from the drive, the strips pass around idler rollers 168 and are laterally separated and spaced apart by the spreader 00. The spreader has two fixed shafts 170 and 172 carried by the stand 72, and around which only one strip 66 passes. To laterally shift this strip 66 so that it will be offset or spaced apart from the other strip 64, the axes of the shafts 170,172 are inclined to each other at an acute included angle which varies with the distance the strips are to be offset and is usually about 25° to 35°.

To permit longitudinal adjustment of each strip relative to the membrane cutting die 96, each strip passes through an associated compensator 74 or 76. Each compensator has a pair of idler rollers 174 journalled for rotation and carried by the die stand, and a third roller 176 journalled for rotation in and carried by a bracket 178 so that it is movable relative to its associated rollers. To position each third roller, it is manually adjusted by a screw 180 threaded in a carrier plate 182 and with a crank handle 184 fixed to one end and at the other end connected by a swivel 186 to the bracket 178.

After each strip emerges from a compensator, it passes through a separate guide and steering device 78 or 80 which preferably is manually adjustable. Each guide has a pair of idler rollers 188 and 190, at least one of which is mounted so that the orientation of its axis can be adjusted and varied with respect to the axis of the other roller to laterally shift or steer and guide the strip. The construction and arrangement of these guides is generally similar to the web guide 54 except they are manually rather than automatically adjusted. Suitable guides are previously known and commercially available from Fife Corporation under the trade name Fife E/M Guiding Systems.

Applicators

If it is desired, to tack the pull tabs to the membrane after they have been folded, a drop of an adhesive or glue can be applied to each strip in an area 192 (as shown in FIG. 5) which will underline the tab after it has been folded. Suitable adhesive applicators 194 may be of conventional design and are commercially available from Nordson Corp., 350 Research Court, Norcross, Ga. 30092, under the model designation 2302.

Tab Folders

Each strip passes through a separate folder device 84 which folds the pull tabs 36 on their crease lines 144 and over the strip. Each tab is moved generally about its fold line through an arc of about 100° as it passes through a chute 196 having a helical edge or leaf 198 which deflects the tab through this arc as it advances through the chute. As the tab emerges from the chute it is engaged by a moving belt 200 which in cooperation with another moving belt 202 underlying its associated strip further accurately deflects the tab so it overlies and is forced into firm engagement with the strip, as shown FIG. 6. Usually, as shown in FIG. 6, small portions 204 of the edge of the strip are also folded over by these folding devices.

The belt 202 is received on and carried by idler and drive rollers 206, 208 with axes parallel to each other, and the belt 200 is received on and carried by a drive roller 210 with its axis parallel to the axis of roller 208 and an idler roller 212 and with its axis generally perpendicular to the axes of the other rollers. Preferably, the drive rollers 208 and 210 are driven by a variable speed electric motor so that the lineal surface speed of both belts is the same as the lineal surface speed of the strip passing through the folder.

The strips are guided through the spreader, compensators and folders by a plurality of conventional cylindrical idler rollers 214, each journalled for rotation and carried by the die stand.

Guides and Drive for Strips

The strips are steered and fed into the membrane cutting die 96 by the guides 86 and 88, drive 90 and associated cylindrical idler rollers 216, which are journalled for rotation and carried by the die stand 92. Preferably, the guides are of the automatic type, may be of conventional design and are commercially available from Fife Corporation under the trade name Fife E/M Guiding System.

The drive 90 has a separate and independent idler roller 218 for each strip which urges its associated strip into firm engagement with a common single drive roller 220 journalled for rotation and carried by the stand 92. Preferably, the idler and drive rollers have plain cylindrical surfaces and are made of steel. Preferably, each idler roller has a rubber coated cylindrical surface. Preferably, the drive and idler rollers are journalled in blocks 222 slidably received and removably secured in slots 224 in the stand so they can be removed and replaced as needed. Preferably, the blocks are releasably secured in the slots by jack screws 226 threadably received in a carrier plate 228 and with a crank handle 230 on one end and the other end connected by a swivel 232 to a block.

Cutting Die Assembly

A plurality of individual membranes 34 are cut and completely severed from each strip by the co-rotating cutting die 96 and anvil 98 cylinders. The scrap 64' and 66' produced when cutting membranes is withdrawn through the chute 100 to which a vacuum is applied and disposed of.

Figure 10:
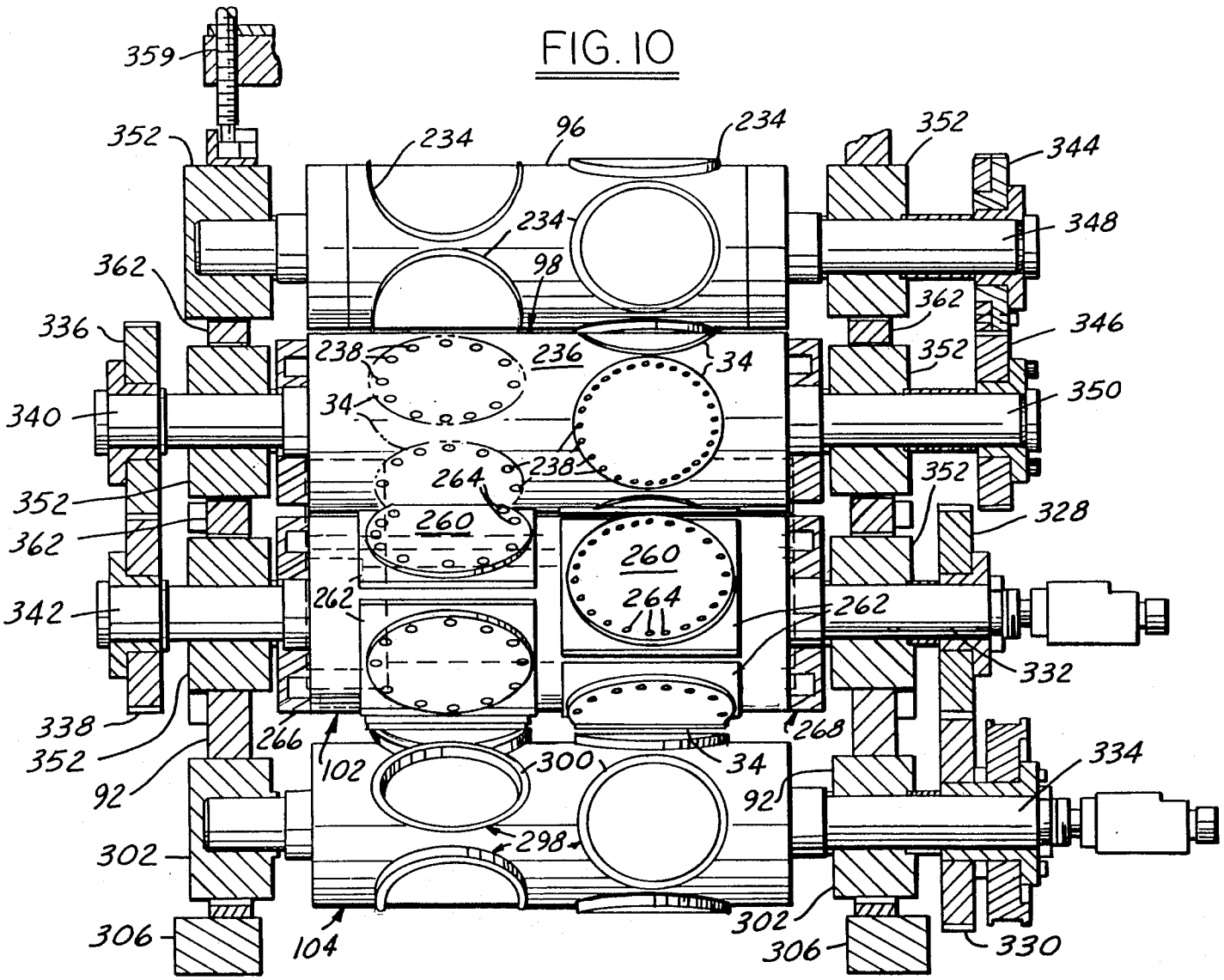
FIG. 10 is a fragmentary sectional view taken generally on line 10—10 of FIG. 9 and showing the mounting of the rollers in the support stand.

As shown in FIG. 10, for each strip the die cylinder has four equally circumferentially spaced and radially projecting cutting elements 234 which in cross section have a generally V-shaped knife edge which cuts through the strip. Each cutting element 234 is constructed and arranged to produce what will be in the flat a generally circular cut defining the outer periphery of the membrane. Preferably, although not necessarily, to more evenly distribute the loading on the die cylinder the cutting elements for the two strips 64 and 66 are staggered or offset circumferentially so their centers are angularly displaced 45° relative to each other as shown in FIG. 10. The anvil 98 has a plain cylindrical surface 236 which cooperates with the cutting elements to sever and completely cut through the strips to form the individual membranes. The construction and arrangement of the anvil and die cylinders and cutting elements and a preferred method of making them is disclosed in U.S. Pat. Nos. 3,550,479 and 3,796,851, which are incorporated herein by reference and hence will not be described in greater detail.

Figure 8:
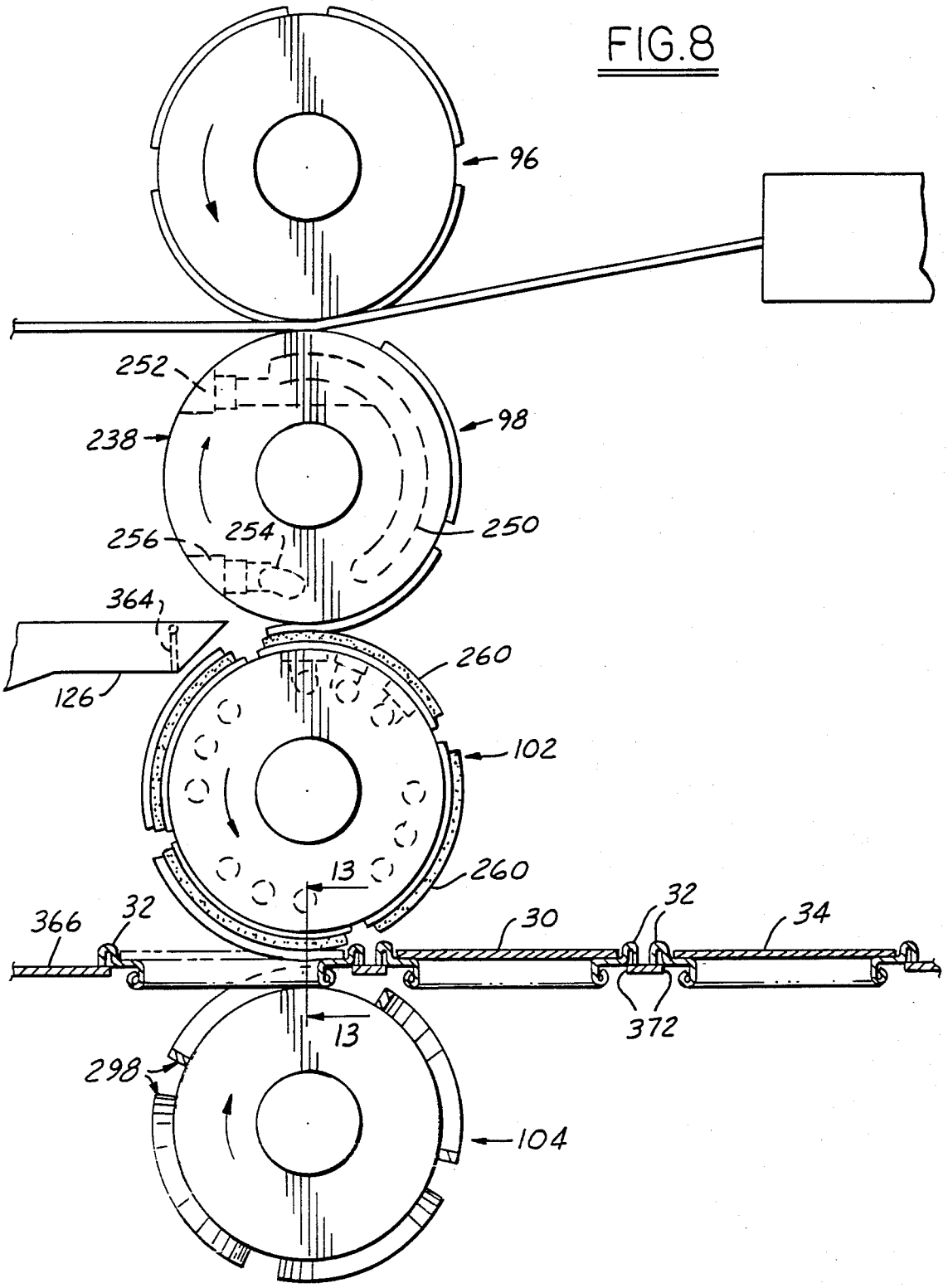
FIG. 8 is a enlarged and semi-schematic end view of the rotary die, anvil, transfer, and support rollers of the machine of FIG. 3.

As shown in FIGS. 8 and 10, as each membrane 34 is severed from its associated strip it is retained on the anvil cylinders. Each membrane is retained by a vacuum applied to a plurality of underlying ports 238 (FIG. 10) arranged in a generally circular pattern in the cylinder. When each membrane is rotated by the anvil cylinder to a position where its leading edge is immediately adjacent the transfer roller 102 (FIG. 8), it is sequentially or segmentally released from the anvil and received by the transfer roller. Each membrane is released by selectively and sequentially applying compressed air to the ports 238 underlying it.

Vacuum and pressurized air are applied to the ports 238 in the desired sequence by the cooperation of a pair of manifolds 239 and 240 with anvil connector passages each communicating with one end of the anvil cylinder and a selected zone or group of the ports 238 associated with one membrane receiving area. For example, as shown in FIGS. 16 and 17, for each membrane receiving area four circumferentially spaced apart and axially extending passages 242, 244, 246 and 248, communicate with only one of four selected groups or zones respectively **242*a*, 244*a*, 246*a* and 248*a*** of the ports underlying a membrane.

As shown in FIGS. 8 & 18, each of the manifolds has a relative long arcuate groove segment 250 therein to which a vacuum is applied through a port 252 and a relatively short arcuate groove segment 254 to which compressed air is applied through a port 256. The manifolds in conjunction with the cylinder form rotary valves controlling the ports. Thus, in operation, as the anvil cylinder rotates relative to the manifolds, the ports 238 for each membrane receiving area are sequentially and alternately subjected to vacuum and compressed air to retain and release an overlying membrane.

Preferably, to facilitate initial setup and operation of the machine, each manifold 239 and 240 can be rotated within predetermined limits relative to the anvil cylinder to vary and adjust the phase relationship or timing of subjecting the ports 238 to vacuum and compressed air and hence the securing and releasing of a membrane. Once a manifold is adjusted to its desired position, it can be secured by conventional mechanism (not shown).

Transfer Roller

Normally each membrane is passed from the anvil cylinder 98 to the transfer roller 102. Each membrane is received on a pad 260 of a resilient material, such as silicone rubber, adhered to a carrier plate 262 releasably secured to the transfer roller. The pads 262 have a durometer which is usually in the range of about 60 to 90, desirably 70 to 80 and preferably about 75. Each membrane is releasably retained on the transfer roller by a vacuum applied to a plurality of ports 264 through each carrier plate and pad which are arranged in a generally circular pattern and underlie the membrane.

To increase the gap between adjacent membranes, each membrane is accelerated by the transfer roller before it is applied to a ring. This acceleration may be accomplished by constructing the transfer roller so that the diameter of the outer face of its resilient pads 260 is greater than the diameter of the outer cylindrical face of the anvil cylinder 98. With this construction, the outer face of the resilient pads will rotate at a higher lineal surface speed and hence accelerate a membrane when received thereon even though both the anvil cylinder and transfer roller rotate at the same rate or same number of revolutions per minute.

Figure 19:
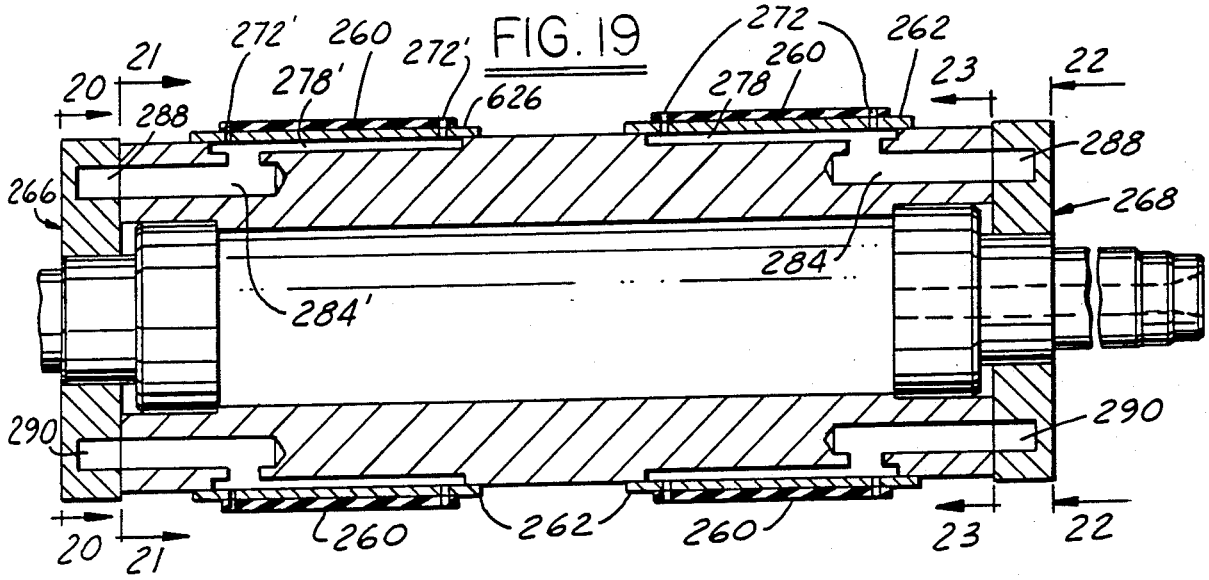
FIG. 19 is a fragmentary sectional view of the transfer roller of the machine of FIG. 3.
Figure 20:
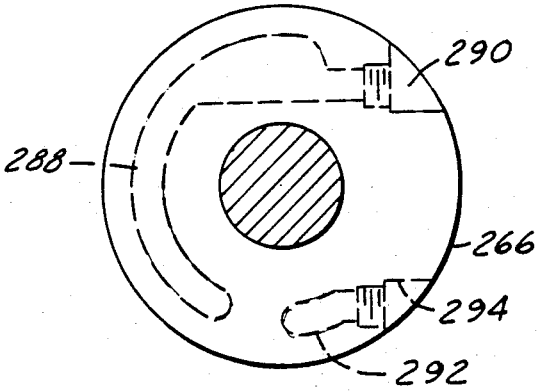
FIGS. 20 and 21 are end views of one manifold and its associated end of the transfer roller taken generally on lines 20—20 and 21—21 respectively of FIG. 19.
Figure 21:
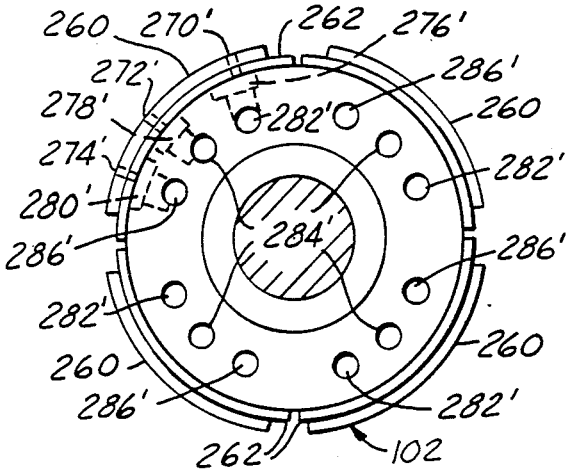

As the transfer roller 102 applies a membrane 34 to an underlying ring 32 (as shown in FIGS. 8 & 13), it is sequentially released from the resilient pad 260 by sequentially applying compressed air to the ports 264 through the pad. Vacuum and compressed air are alternately and sequentially applied to the ports 264 to secure and release each membrane by the cooperation of manifolds 266 and 268 and a plurality of roller passages (FIGS. 10 and 19) each communicating with only one end of the roller and with only one selected group or zone of the ports of one of the pads. As shown in FIGS. 19–21, each pad adjacent one end of the roller has three groups or zones 270, 272 and 274 of ports 264 which respectively communicate with one of three recesses 276, 278 and 280 which respectively communicate with one of three passages 282, 284, 286 which open into one end of the roller. Similarly, as shown in FIGS. 22 & 23, each of the pads adjacent the other end of the roller has three groups or zones 270', 272', 274' of ports 264 which respectively communicate with one of three recesses 276', 278' and 280' which communicate respectively with one of three passages 282', 284' and 286' which open into the other end of the roller.

Figure 22:
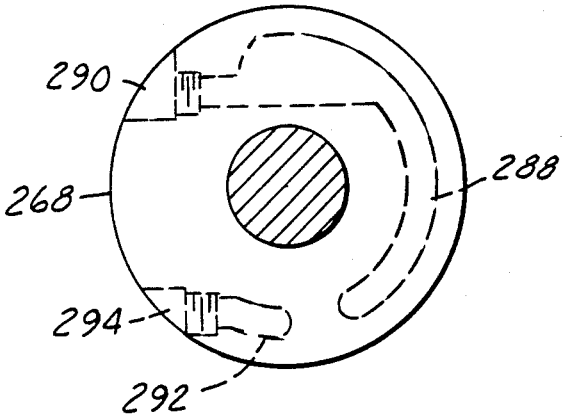
FIGS. 22 and 23 are end views of the other manifold and its associated end of the transfer roller taken generally on lines 22—22 and 23—23 respectively of FIG. 19.
Figure 23:
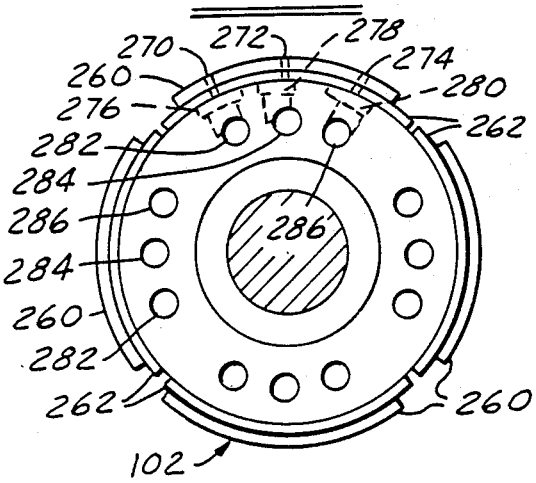
Figure 24:
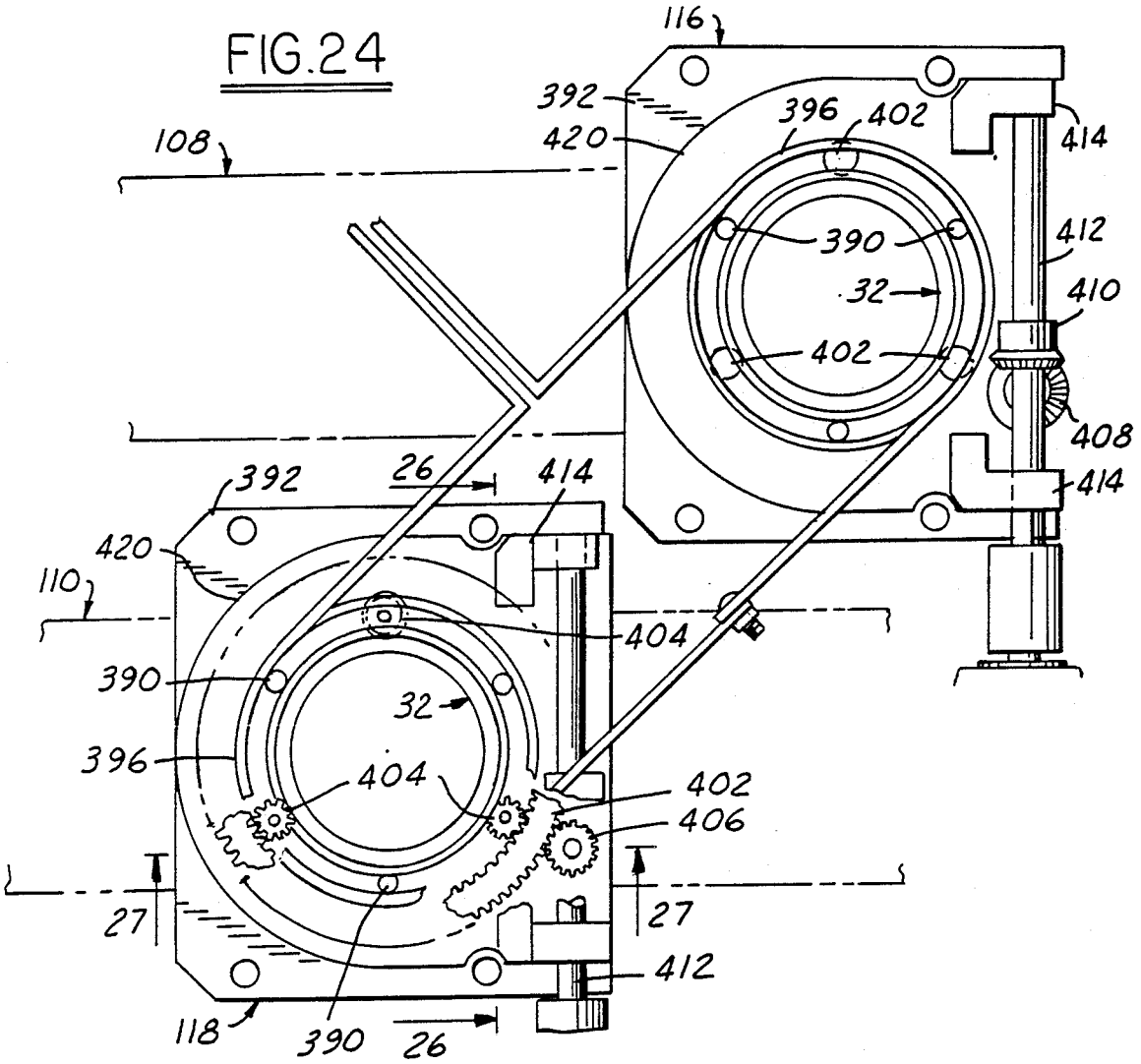
FIG. 24 is a plan view of ring downstackers of the machine of FIG. 3.

As shown in FIGS. 20 & 22, each of the manifolds 266 & 268 has a relatively long arcuate groove segment 288 therein to which a vacuum is applied through a port 290 and a relatively short arcuate groove segment 292 to which compressed air is applied through a port 294. The manifolds in conjunction with the roller form rotary valves controlling the ports. Thus, in operation, as the transfer roller 102 rotates relative to the manifolds 266 & 268 the ports 264 of each pad are sequentially and alternately subjected to vacuum and compressed air to secure and release an overlying membrane. Preferably, to facilitate setup and adjustment of the machine, each manifold 266 & 268 can be rotated within predetermined limits with respect to the roller 102 to vary and adjust the phase relationship or timing of the application of vacuum and compressed air to the ports and then secured in the desired adjusted position by conventional mechanism (not shown).

Typically, the vacuum applied to the ports 238 & 264 of both the anvil cylinder and transfer roller is about 6 to 7 inches of Hg when open and 7 to 8 inches of Hg when closed or covered by a membrane. Typically, compressed air is applied to the ports at a pressure of about 15 to 25 PSIG.

Support Roller

As the transfer roller 102 applies a membrane to an underlying ring, the resilient pad 260 firmly urges the membrane into engagement with the ring and produces a wiping or ironing action which tends to avoid and remove any wrinkles in the application of the membrane. While the membrane is being applied, the ring is urged into firm engagement with the pad and preferably is lifted slightly from the conveyor belt by the underlying support roller 104. The rings bear on generally circular ribs 298 equally circumferentially spaced apart on the support roller and projecting radially outward. Preferably, each rib 298 has sufficient radial height and a cylindrical outer face 300 so that during application of the membrane, the underside of the flange 42 of the ring bears on the face 300 of the rib and has essentially only straight line contact therewith directly under the portion of the flange on which the membrane is being urged by the resilient pad. Preferably, the line of contact between the rib 300 and flange 42 and the line of contact between the portion of the membrane 34 being urged by the pad 260 onto the flange both lie essentially in the same plane containing the axes of the transfer and support rollers 102 & 104.

Roller Carrier

To permit the support roller to be deflected from its normal position by a ring passing over the roller which is mislocated on the conveyor belt, and thereby avoid damage to the transfer and support rollers, the support roller is mounted in a yieldable carrier 106. As shown in FIGS. 9 and 11, the roller 104 is journalled in bearing blocks 302 slidably received in slots 304 in the die stand and resting on bearer blocks 306 fixed adjacent one end to a pair of spaced apart arms 308 secured to a pivot shaft 310 journalled by bushings 312 carried by the stand 92. Each arm 308 is urged toward the support roller by an air cylinder 314 with its piston rod connected to one end of the arm by a clevice 316. The force with which the support roller urges the ring into engagement with the pad of the transfer roller can be varied and adjusted by varying the pressure of the air supplied to each cylinder.

The extent to which the arms 308 can pivot the support roller 104 toward the transfer roller 102 is controlled and limited by adjustable cams 318 which underlie bearer plates 320 secured to the other end of the arms 308. As shown in FIG. 12, to facilitate this adjustment, a turn knob 321 is fixed to one end of a shaft 322 to which the cams 318 are secured. The shaft is journalled for rotation in the stand 92 and releasably secured in its adjusted position by a clamp mechanism 324. Rotation of the shaft 322 turns in the cams 318 in unison to vary and adjust the extent to which the support roller can be moved toward the transfer roller.

Cylinder & Roller Drive

Preferably, the cylinders and rollers in the die stand 92 are driven by a common variable speed electric motor 326 which can be directly connected to both the drive roller 220 and transfer roller 102 through conventional gear trains (not shown) with anti-back lash mechanisms. Preferably, the transfer and support rollers 102 and 104 are operably connected together for co-rotation in opposite directions at essentially the same surface speed by meshed gears 328 & 330 secured to their respective stub shafts 332 & 334 and having conventional back-lash mechanisms. The anvil cylinder 98 is driven from the transfer roller through meshed gears 336 & 338 with anti-back lash mechanisms secured to their respective stub shafts 340 & 342. The die and anvil cylinders 96 & 98 are co-rotated in opposite directions and with essentially the same surface speed through meshed gears 344 & 346 with conventional back-lash mechanisms secured to their stub shafts 348 & 350. As previously indicated, to accelerate the membranes, the surface speed of the outer face of the resilient pads 260 of the transfer roller 102 is somewhat greater than that of the cylindrical surface of the anvil cylinder 98 which can be achieved by making the pads with a larger diameter than that of the surface of the anvil cylinder.

Mounting of Cylinders & Rollers

To facilitate removal and replacement of the various cylinder and rollers, preferably their bearing blocks 352 are slidably received in the slots 304 in the die stand 92 and releasably retained therein by clamps with jack screws 354 threaded in a support plate 356. The screws can be rotated by handles 358 fixed to one end and on the other end have swivel heads 360 which bear on the blocks 352 of the membrane die cylinder 96. Preferably, in assembly, the axis of rotation of the transfer roller 102 assumes a fixed position so that the axis of both the support roller 104 and the anvil cylinder 98 can be varied and adjusted within predetermined limits relative thereto for proper setup, alignment and operation of the machine. Preferably, the axis of rotation of the cutting die cylinder 96 can be varied and adjusted within predetermined limits relative to the axis of the anvil cylinder for proper alignment and spacing for cutting membranes from the strips of material. This spacing can be varied by using spacer blocks 362 and shims of varying thickness. Typically, the spacing between the knife edge of the cutting elements of the die cylinder 96 and the anvil cylinder is less than one tenth of the thickness (t) of the web of material. Typically, the spacing between the anvil cylinder and the pads 260 of the transfer roller 102 is about twice the thickness (2t) of the web plus 0.002 to 0.004 of an inch.

Temperature Sensing of Ring and Membrane Removal

To avoid defective lid assemblies, if each ring is not hot enough to insure good adhesion of a membrane, it is not applied to the ring. Since it is difficult to non-destructively test for and detect insufficient adhesion of a membrane to a ring, it is preferable to simply not apply a membrane to a ring unless it is definitely hot enough to produce adequate adhesion.

Shortly before each ring passes under the transfer roller, its temperature is sensed by an infrared sensor 122 or 124. Each sensor is located so a portion of the flange 42 of the ring will pass directly over it. If the ring is not hot enough to insure proper adhesion i.e. a "cold" ring, the sensor actuates control circuitry which causes the membrane which would otherwise be applied to the ring to be released from the transfer roller 102 and removed through the vacuum chute 126. For a Surlyn adhesive, a minimum or "cold" ring temperature is about 325° F. The sensors may be of conventional design, are commercially available from Vanzetti Systems, Inc., 111 Island Street, Stoughton, Mass. 02072, as Model LTD-O-F-09-3-LP-E and hence will not be described in detail.

The membrane is released from the transfer roller by applying compressed air to its underlying ports through the arcuate groove 288 of its associated manifold 266 or 268 to which a vacuum is normally applied. This can be accomplished by a conventional solenoid actuated control valve which momentarily disconnects the vacuum source and couples the groove 288 of the manifold to a source of compressed air. .

Preferably, the chute 126 is continuously connected to a source of vacuum such as an exhaust fan and has a normally closed control door 364 adjacent its inlet which can be opened by a conventional solenoid actuted by the infrared sensor. Opening this door causes the vacuum to produce a stream of air which sweeps the released membrane into the chute.

Ring Conveyors

Preferably, two identical conveyors 108 & 110 disposed side by side each deliver rings to one of the two tracks or paths under the transfer roller. Each conveyor has an endless belt 366 (FIG. 3) of stainless steel received on a drive roller 368 and an idler roller 370 and having an upper run which passes between the transfer and support rollers. As shown in FIGS. 8 & 14, each belt 366 has a plurality of equally longitudinally spaced apart through holes 372, each of which is constructed to receive a ring with its outer rim bearing on a marginal portion of the belt adjacent the periphery of the hole. As shown in FIGS. 14 and 15, each ring is located on the belt by bearing on a pair of locator pins 374 fixed to the belt adjacent a trailing portion of the ring. Preferably, each ring is urged into engagement with these pins just before it passes under the transfer roller by a wiper 376, as shown in FIG. 3.

Each drive roller 368 is separately journalled for rotation in and carried by the die stand 72. Each drive roller is driven in synchronization with the transfer and support rollers, preferably, by a separate variable speed electric motor 378 with conventional synchronizing control circuitry. However, if desired, each drive roller can be driven by a mechanical coupling with the drive motor 326 for the transfer roller 102 such as through coupling shaft and gears or timing belts or chains and pulleys or sprockets.

The tension on each conveyor belt can be varied and adjusted within predetermined limits by a separate tensioner device 114 having a pneumatic cylinder 380 mounted on a support 382 and with its piston rod 384 secured to a yoke 386 in which the idler roller 370 is journalled for rotation.

Downstacker and Heater

Figure 25:
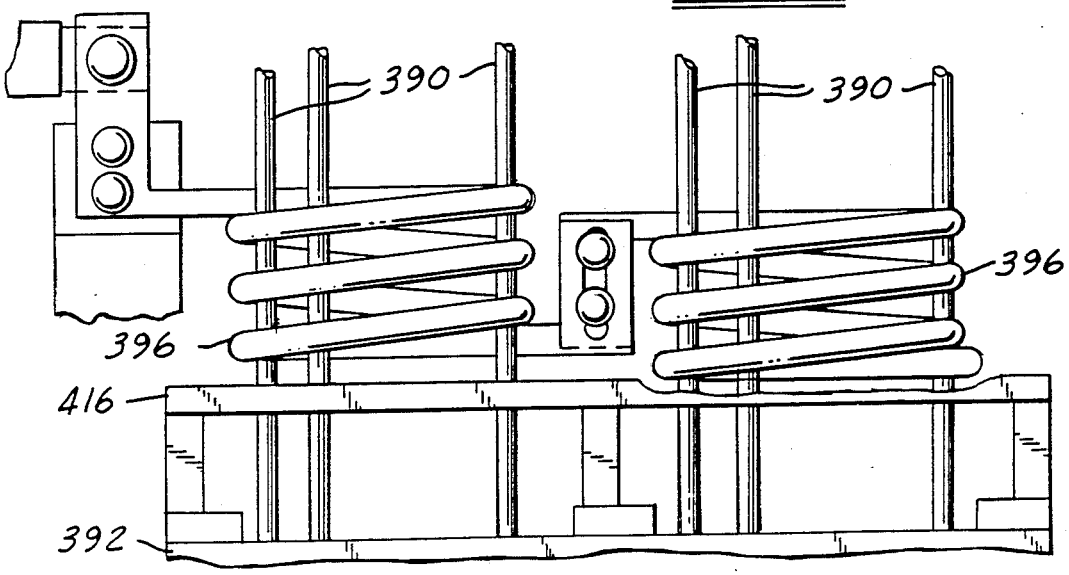
FIG. 25 is an enlarged and fragmentary side view of the ring downstrackers.

The rings are heated and placed on the moving conveyor belts by a separate stacker device 116 and 118 for each belt 108 & 110. Since the downstackers are of identical construction and arrangement, only one will be described in detail. In each device, a stack of a plurality of rings 32 is received between three upstanding and circumferentially spaced apart guide rods 390 of a non-metallic material, such as fiberglass, which are secured at their lower ends to a base plate 392 received on a support stand 394 secured to the base 120. The rings are heated to an elevated temperature as they pass through induction coils 396 (FIG. 25) connected in series to a suitable alternating current power supply 398. Each induction coil is water cooled and along with the power supply may be of conventional construction. Preferably, the current applied to the coils is varied and regulated to maintain a predetermined desired temperature to which each ring is heated. This can be accomplished by an infrared temperature sensor focused on each ring when received in the coil and conventional control circuitry. Typically, for a Surlyn adhesive each ring is heated to a temperature of about 400° F. to 430° F.

Figure 26:
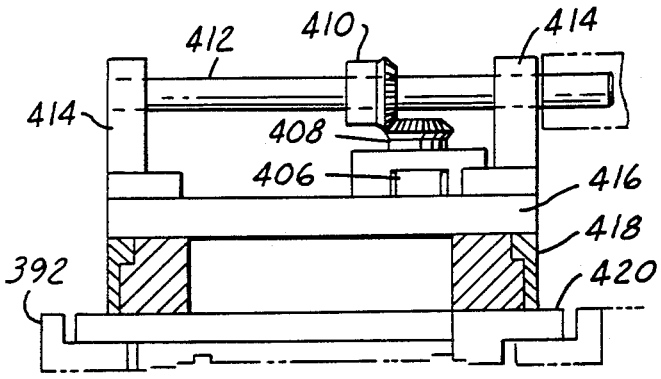
FIG. 26 is a sectional view taken generally on line 26—26 of FIG. 24 and showing a portion of the drive of one downstacker.
Figure 27:
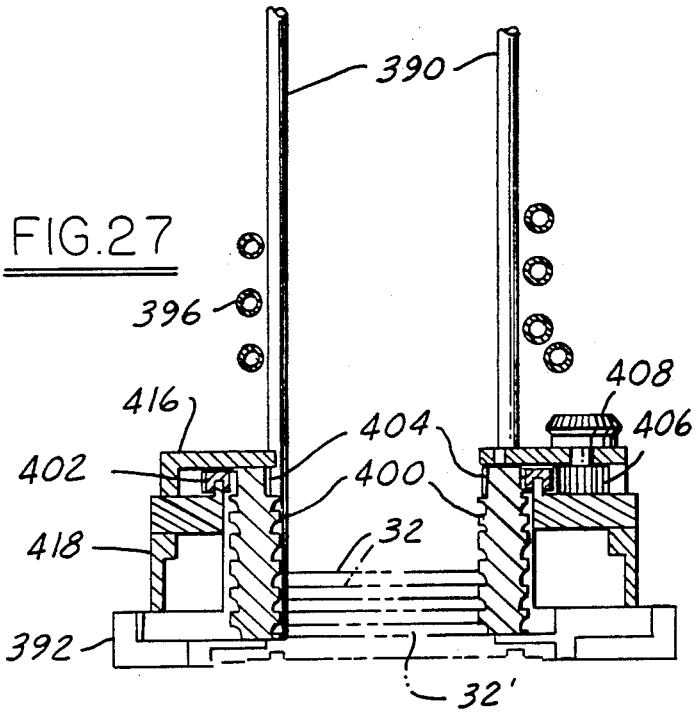
FIG. 27 is a sectional view taken generally on line 27—27 of FIG. 24 and showing a portion of the metering mechanism of one ring downstacker.

As shown in FIG. 27, several of the rings 32 adjacent the bottom of the stack are received in the helical grooves of three circumferentially equally spaced apart metering worms 400 which engage the outer periphery of the rings. When the metering worms are rotated in unison, they advance the rings and periodically release the lowermost ring 32' so it is deposited on the underlying conveyor belt. The metering worms are rotated in unison by a ring gear 402 with internal teeth which mesh with a drive gear 404 keyed to the upper end of each worm. The ring gear is driven by a pinion 406 which meshes with external teeth of the ring gear and is coupled to a bevel gear 408 which meshes with a complimentary bevel gear 410 (FIG. 26) keyed to a transverse drive shaft 412 journalled for rotation in support blocks 414. These support blocks are fixed to a cover 416 secured to a housing 418 fixed to a carrier plate 420. To facilitate clearing jam ups of rings from the stacker, its carrier plate 420 is releasably secured to the base plate 392 to permit rapid removal and replacement of the stacker.

To provide proper synchronization of the depositing of rings on a conveyor belt, each drive for each downstacker needs to be constructed and arranged so that its timing and phase relationship with its associated conveyor belt can be varied and adjusted independently of the other conveyor belt. This can be accomplished by using a separate variable speed electric motor (not shown) connected to the drive shaft 412 of each downstacker and synchronized with the drive of its associated belt. This can also be accomplished, frequently more economically, by an appropriate mechanical coupling of the drive shaft of each downstacker to the drive of its associated belt, such as by an appropriate arrangement of gears, shafts, differentials and a coupling which is adjustable to shift or change the phase or timing relationship between each downstacker and its associated belt.

Usually, each ring is released by a downstacker ahead of the hole 372 in the belt 366 in which it will be received a distance equal to about one half the outside diameter of the ring. Each ring is urged into the hole in the belt and engagement with the locator pins 374 by a wiper 422. Preferably, to insure the rings remain in the holes they pass under a retainer rail 424 preferably of teflon. Preferably, to insure the rings bear on the locator pins 374 they also pass under another wiper 376 just before going under the transfer roller 102. Preferably to decrease cooling of the heated rings they pass through a tunnel 428 preferably of a transparent material such as plexiglass.

Defective Lid Detector

After passing under the transfer roller, each ring normally with a membrane thereon passes under one of the defect detectors 132 associated with each conveyor belt. Each detector has a light source 430, photoelectric eye 432 and associated electronic circuitry which senses the defects of no membrane on a ring, a pinhole through a membrane and/or a gap or void across the full radial width of the adhesion of the membrane to its ring. Any of these defects would result in a leaky lid assembly. Suitable detectors 132 may be of conventional design and are commercially available from D. T. Randall Randal & Associates of 1205 North Main Street, Royal Oak, Mich. 48067-1395 as Model No. RA Ski-11F Hole Detector.

When a defect is detected, the detector energizes through appropriate control circuitry with a suitable time delay the deflector 134 which removes defective lid assemblies from the cooling conveyor. The deflector has a gravity chute 426 into which lid assemblies are blown by jets of compressed air discharged by nozzles 428 connected to a source of compressed air through a solenoid actuated control valve.

Cooling Conveyor

The lid assemblies move by gravity down the inclined slide 128 from both ring belts onto the cooling conveyor 130. The cooling conveyor has a continuous belt 434 received over spaced apart drive 436 and idler 438 rollers, each journalled for rotation and carried by the base 62. This conveyor is driven by an electric motor 440 coupled to the drive roller by conventional belts and pulleys. Preferably this is a variable speed electric motor, which normally drives the conveyor belt 34 at a greater lineal surface speed than and in a fixed ratio to that of the ring belts 108 & 110.

Cooling Fans

The lid assemblies pass under one or more cooling fans 136 which produce a relatively large volume and high velocity stream of air to cool the lid assemblies 30. Due to the relatively high mass to exposed surface area of the rings it is necessary to direct a relatively large volume of turbulent air over the lid assemblies in order to fairly rapidly cool them to an ambient temperature to thereby insure complete sealing and adequate adhesion of a membrane to its ring by the Surlyn or other thermal plastic adhesive. After cooling the lid asemblies 30 are completed and are ready to be packaged, shipped and used.

Modified Machine

Figure 28:
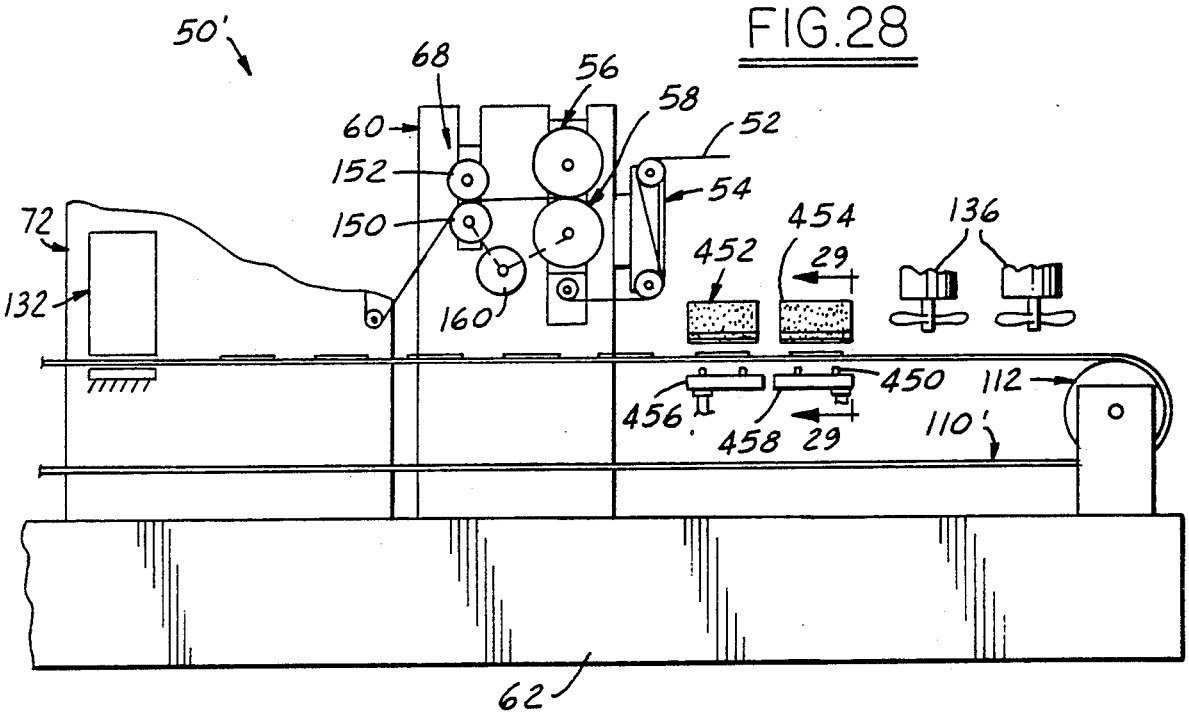
FIG. 28 is a fragmentary side view of a modified machine embodying this invention for making can lids.

FIG. 28 illustrates a modified machine 50' which is essentially the same as machine 50 except that it does not have a separate cooling conveyor. Rather, in machine 50' the substrate belt conveyors 108' and 110' are extended so they also convey the lid assemblies under the cooling fans 136.

Figure 29:
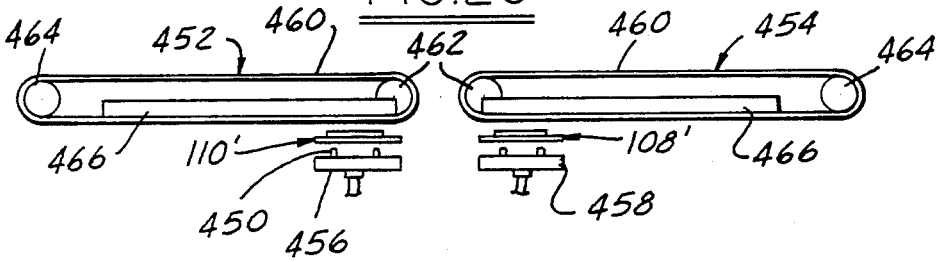
FIG. 29 is a fragmentary view taken generally on line 29—29 of FIG. 28 and illustrating conveyors for removing defective can lids.

As shown in FIGS. 28 and 29, in machine 50' defective lid assemblies are propelled upward off the conveyor belts 108' and 110' by jets of compressed air released from nozzles 450 and removed by discharge conveyors 452 and 454. The nozzles 450 underlie the upper run of each belt and are connected to manifolds 456 and 458 to which compressed air is supplied. The supply of compressed air to each manifold is controlled by a solenoid control valve actuated through appropriate control circuitry by the defective lid detectors 132.

Each conveyor 450 and 452 has an endless belt 460 received on idler 462 and drive 464 rollers and is driven by an electric motor (not shown) so that its lower run moves outward transversely away from its associated lid assembly conveyor 108' or 110'. Each lid assembly propelled upward off its associated conveyor 108' and 110' is drawn into firm frictional engagement with the overlying lower run of the discharge conveyor 450 or 452 by a magnet 466. While frictionally engaged each lid assembly is moved outwardly by the moving belt 460 and when the lid assembly is moved beyond the field of the magnet it drops by gravity preferably into an underlying container (not shown). Preferably, each magnet 466 lies closely adjacent the upper or inner face of the lower run of the belt 460. Preferably to facilitate setup and adjustment of the discharge conveyors 450 and 452 and their use with runs of different substrates, each magnet 466 is an electromagnet connected to an adjustable power supply permitting so that its magnetic force can be varied and adjusted.

Control Circuitry

To both manually and automatically cycle and operate the machine it has electric, electronic and pneumatic control circuitry and panels and operator control and indicator panels or consoles. Since suitable circuitry, control panels and consoles will be readily apparent to skilled persons, can be of conventional design and construction, and are not part of this invention, they will not be described herein.

Setup and Operation

The machine is initially installed and connected to suitable sources of electric power, compressed air, vacuum and water. When initially starting up the machine 50, the web 52 is threaded over the web guide 54, around an idler roller 149 and into the nip of the cutting die and anvil cylinders 140 & 142 which are slowly rotated manually or by the drive motor to sever a portion of the web into two strips which are then inserted into the nip of the drive and idler rollers 150 & 152. One strip is then passed and threaded around the separator 70, and both strips threaded through compensators 74 & 76, guides 78 & 80, folders 84, guides 86 & 88, drive 90, associated idler rollers and into the nip of the membrane die and anvil cylinders 96 & 98. Stacks of rings are placed in the downstackers 116 & 118 and the induction coils 396 and power supply 398 are energized to heat the rings. The belt conveyors 108 & 110 and downstackers are energized to deposit heated rings on the belts 366 and convey them between the transfer and support rollers 102 & 104.

During initial setup and as needed thereafter, the automatic web guide 54 is adjusted to properly steer the web 52 into the cutting die 56, the manual guides 78 & 80 are adjusted to steer the strips 64 & 66 into the tab folders 84 and the automatic guides 86 & 88 are adjusted to steer the strips into the membrane cutting die and anvil cylinders 96 & 98. The speeds of the motors 160 & 326 are synchronized and hence the drives 150 & 220 for the tab and membrane die cylinders 56 & 96 and associated anvil cylinders and rollers driven by them are synchronized. The spacing and orientation of the axes of the die cylinders 56 & 96, cooperating anvil cylinders 58 & 98, and transfer and support rollers 102 & 104 are also varied and adjusted somewhat to produce the desired cutting and transfer actions. The strip compensators 74 & 76 are each manually adjusted to compensate for differences in the length of the strips and the phase relationship, timing or location of the center line of the tabs in relation to the center of the membranes cut by the die and anvil cylinders 96 & 98.

Preferably thereafter, to insure a smooth handoff, of each individual membrane onto the anvil cylinder 98, each of its associated manifolds 238 & 240 is individually rotated and adjusted to properly time the application of vacuum and compressed air to the ports 238 of the anvil cylinder and then secured in the appropriate position. Similarly, to insure a smooth handoff or passage of each membrane from the anvil cylinder 98 to the transfer roller 102 and application by the transfer roller to a heated ring 32 each of its associated manifolds 266 & 268 is individually rotated and adjusted to properly time the application of vacuum and compressed air to the ports 264 of the pads 260 and then secured in its adjusted position. Since, the handoff of membranes from the anvil cylinder to the transfer roller is influenced by the ports of both of them it may be necessary to first adjust one and then the other of their manifolds several times in order to ultimately achieve the proper transfer of each membrane from one to the other and then its application to a ring.

Subsequently, the speed and phase relationship of the belt 366 of each ring conveyor 108 & 110 to its associated track of the transfer roller 102 is varied and adjusted to properly register the rings carried by the belt with the membranes carried by the transfer roller for application of membranes to the rings. This is accomplished by varying and adjusting the speed and phase relationship of the electric motor or other drive for each conveyor. The speed and phase relationship or timing of the depositing of rings by the downstacker for each belt can then be varied and adjusted by adjusting the motor or other drive for each downstacker.

In operation of the machine 50, the web 52 is steered by the automatic guide 54 and drawn by the drive 68 through the first rotary die and anvil cylinders 56 & 58 which cut out the tabs 36 and sever the web into two strips 64 & 66. The strips are separated laterally by one of them passing through the spreader 70 and thereafter they are processed in two generally parallel paths or tracks.

The strips are steered by the manual guides 78 & 80 into separate folders 84 which fold the tabs 36 about the fold lines 144 through an arc of about 180° to overlie the strips. If desired, just before folding, a drop of adhesive can be applied by optional dispensers 194 to tack or retain the tabs in their folded position. The strips are steered by separate automatic guides 86 & 88 and driven by the drive 90 into the co-rotating cutting die and anvil cylinders 96 & 98 which cut and completely sever individual membranes from the strips. The scrap material 64' & 66' produced by cutting membranes passes into and is removed by the vacuum chute 100.

As each individual membrane is being cut, it is received on and transferred to the anvil cylinder 98 by vacuum applied to its ports 238 (as shown in FIG. 8), advanced through part of a revolution of the anvil cylinder and handed off and transferred onto a resilient support pad 260 on the transfer roller 102. This handoff and transfer is accomplished by the co-rotation of the anvil cylinder, transfer roller and the sequential application of compressed air and vacuum to their ports 238 & 264 by the cooperation of their associated manifolds 238, 240 & 266, 268. During a partial revolution of the transfer roller, each membrane received on a pad is accelerated and then transferred and applied to an underlying ring 32 delivered by a belt conveyor 108 or 110 and urged into engagement with the membrane on the pad by the underlying support roller 104. As each membrane is applied to a ring, it is sequentially released from its associated applicator pad 260 by compressed air applied to the underlying ports 264 by the cooperation of an associated manifold 266 or 268.

The rings are heated to a predetermined elevated temperature by the induction coils 396 in the stackers, each of which deposits rings one at a time on its associated continuously moving conveyor belt 366. Each ring drops by gravity onto its associated belt and is urged into an underlying receiving hole 372 and engagement with associated locator pin 374 on the belt by the wiper 422. Preferably just before passing under the transfer roller, the rings are again urged into engagement with their associated locator pins by another wiper 376.

The temperature of each ring is sensed by the detector 122 or 124 and if the temperature is not high enough to insure proper adhesion of the membrane t the ring, the membrane is removed from the transfer roller and not applied to the ring. To remove the membrane, the detector initiates opening of the door 364 of the vacuum chute 126 and releasing the membrane from the transfer roller so that it will pass into the chute. The membrane is released by application of compressed air to the ports 264 underlying it by interrupting the vacuum and applying compressed air to the normally evacuated groove 288 of the appropriate manifold 266 or 268 associated with the transfer roller. When rings with a high enough temperature are again sensed by the detector, it initiates closing of the door 364 of the chute 126 and shuting off the compressed air and coupling the vacuum to the groove 288 of the appropriate manifold so that membranes are again received and retained on the transfer roller and subsequently applied to the rings.

Downstream of the transfer roller, any defects in the lid assembly which would result in leaks are detected by the photoelectric sensor 132 which actuates the deflector 134 to remove defective lid assemblies from the cooling conveyor 130. The lid assemblies are moved by the conveyor under the cooling fan 136 which relatively rapidly cools them to an ambient temperature and then they are ready to be packaged, shipped and used.

I claim:

1. A machine for cutting blanks from a web of flexible material with a polymer adhesive thereon and applying them to a substrate comprising: coacting die and anvil cylinders journalled for rotation with their axes substantially parallel to each other, at least said die cylinder having radially projecting severing elements thereon constructed and arranged to cut in cooperation with said anvil cylinder a plurality of blanks from a web of flexible material with a polymer adhesive thereon passing between the die and anvil cylinders when they are co-rotating, at least one set of a plurality of ports on said anvil cylinder and arranged to underlie a blank received thereon, at least one rotary valve having a vacuum port and a pressure port and being operably associated with said anvil cylinder so that as said anvil cylinder rotates each set of its ports is coupled sequentially in at least two circumferentially spaced zones and alternatively with said vacuum port and said pressure port at least once per complete revolution of said anvil cylinder to retain a blank thereon and release it therefrom, a transfer roller journalled for rotation on an axis generally parallel to th axis of rotation of said anvil cylinder, at least one set of a plurality of ports on said transfer roller arranged to underlie a blank received thereon, at least one rotary valve having a vacuum port and a pressure port and being operably associated with said transfer roller so that as it rotates each set of its ports is coupled sequentially in at least two circumferentially spaced zones and alternatively with said vacuum port and said pressure port at least once per complete revolution of said roller to retain a blank thereon and release it while being applied by said roller to a substrate, a heater upstream of said transfer roller and constructed and arranged to heat the substrate to a minimum temperature of at least 250° F. before the substrate passes by the transfer roller, and a drive conveying the heated substrate closely adjacent to and by said transfer roller in synchronization therewith so that as a blank is released from said roller it is transferred, applied and adhered to the heated substrate, whereby when the die cylinder, anvil cylinder and transfer roller are co-rotating blanks are cut from the web, received on and handed off the anvil cylinder, and received on the transfer roller and released, applied and adhered to a substrate to laminate the blanks and the substrate.

2. The machine of claim 1 wherein blanks are applied to a plurality of individual substrates which the drive moves sequentially by the transfer roller and said heater heats each substrate to a minimum temperature of at least 250° F. before each substrate passes by the transfer roller for application of a blank thereto.

3. The machine of claim 1 which also comprises a resilient pad on said transfer roller constructed and arranged to underlie a blank received thereon and to yieldably urge such blank onto a substrate.

4. The machine of claim 1 which also comprises a resilient pad on said transfer roller constructed and arranged to underlie a blank received thereon and to yieldably urge such blank onto a substrate, and said pad having a durometer in the range of about 60 to 90.

5. The machine of claim 1 wherein at least the portion of the transfer roller on which blanks are received has a diameter larger than the diameter of the surface of the anvil cylinder on which blanks are received such that the transfer roller will accelerate the lineal speed of blanks received thereon relative to their lineal speed when on the anvil cylinder.

6. The machine of claim 1 wherein said transfer roller is constructed and arranged to increase the lineal speed of blanks received thereon so that they are transferred onto a substrate at a lineal speed which is greater than the lineal speed of the blank when on the anvil cylinder.

7. The machine of claim 1 which also comprises a resilient pad on said transfer roller constructed and arranged to underlie a blank received thereon and to yieldably urge such blank onto a substrate, the surface of said resilient pad on which blanks are received having a diameter greater than the diameter of the anvil cylinder such that blanks received on the resilient pad are accelerated so they are transferred to a substrate at a greater lineal speed than the lineal speed of the blanks when received on the anvil cylinder.

8. The machine of claim 7 wherein said resilient pad has a durometer in the range of about 60 to 90.

9. The machine of claim 1 which also comprises a support roller journalled for rotation on an axis substantially parallel to the axis of rotation of said transfer roller and having a cylindrical surface which bears on and supports the substrate while a blank is applied thereto by the transfer roller.

10. The machine of claim 1 which also comprises a support roller journalled for rotation on an axis substantially parallel to the axis of rotation of said transfer roller and having a cylindrical surface which bears on and has substantially rolling contact with and supports the substrate while a membrane is being applied to the substrate by the transfer roller.

11. The machine of claim 1 which also comprises a support roller journalled for rotation on an axis substantially parallel to the axis of rotation of said transfer roller and having a cylindrical surface which bears on and has rolling contact with and supports a substrate while a blank is being applied thereto by said transfer roller and said rolling contact is along a path which substantially lies in a plane containing the axes of rotation of both said transfer roller and said support roller.

12. The machine of claim 11 wherein the axes of rotation of said die cylinder, anvil cylinder, transfer roller, and support roller all substantially lie in the same plane.

13. The machine of claim 1 which also comprises a leak detector having a light source and a photoelectric cell constructed, arranged and located so that after a substrate passes by the transfer roller it passes through the path of radiation from the light source to the photoelectric cell such that the photoelectric cell detects any of the defects of a lack of a blank on the substrate, a void in the sealing of a blank to the substrate, and a hole through a blank sealed to the substrate.

14. The machine of claim 13 which also comprises a substrate rejector disposed downstream of said transfer roller and said leak detector and operably connected with said leak detector to be actuated by said leak detector to reject substrates determined by said leak detector to be defective.

15. The machine of claim 1 which also comprises at least one fan constructed and arranged to direct a stream of cooling air onto the substrate downstream of said transfer roller to thereby cool the heated substrate.

16. A machine for cutting blanks from a web of flexible material and applying them to a substrate comprising: coacting die and anvil cylinders journalled for rotation with their axes substantially parallel to each other, at least said die cylinder having radially projecting severing elements thereon constructed and arranged to cut in cooperation with said anvil cylinder a plurality of blanks from a web of flexible material passing between the die and anvil cylinders when they are co-rotating, at least one set of a plurality of ports on said anvil cylinder and arranged to underlie a blank received thereon, at least one rotary valve having a vacuum port and a pressure port and being operably associated with said anvil cylinder so that as said anvil cylinder rotates each set of its ports is coupled sequentially in at least two circumferentially spaced zones and alternately with said vacuum port and said pressure port at least once per complete revolution of said anvil cylinder to retain a blank thereon and release it therefrom, a transfer roller journalled for rotation on an axis generally parallel to the axis of rotation of said anvil cylinder, at least one set of a plurality of ports on said transfer roller arranged to underlie a blank received thereon, at least one rotary valve having a vacuum port and a pressure port and being operably associated with said transfer roller so that as it rotates each set of its ports is coupled sequentially in at least two circumferentially spaced zones and alternately with said vacuum port and said pressure port at least once per complete revolution of said roller to retain a blank thereon and release it while being applied by said roller to a substrate, a drive conveyor constructed and arranged to convey each of a plurality of substrates sequentially closely adjacent to and by said transfer roller in synchronization therewith so that as a blank is released from said roller it is transferred and applied to a substrate, and a stacker constructed and arranged to receive a plurality of substrates and having a dispenser which deposits one substrate at a time onto said drive conveyor upstream of said transfer roller while said drive conveyor is continuously moving, whereby when the die cylinder, anvil cylinder and transfer roller are co-rotating blanks are cut from the web, received on and handed off the anvil cylinder, and received on the transfer roller and released and applied to a substrate carried by said drive conveyor to laminate the blanks to the substrates.

17. The machine of claim 16 which also comprises a heater constructed and arranged to heat to a temperature of at least 250° F. substrates received in the stacker prior to their being deposited on the conveyor.

18. The machine of claim 16 wherein said dispenser comprises at least three spaced apart worms constructed and arranged to simultaneously engage a substrate and when they rotate in unison periodically to release a substrate onto the moving conveyor.

19. The machine of claim 18 which also comprises a heater constructed and arranged to heat to a temperature of at least 250° F. substrates received in the stacker prior to their being deposited on the conveyor.

20. The machine of claim 16 which also comprises an induction coil constructed and arranged to encircle at least one substrate received in said stacker and to heat substrates in the stacker to a temperature of at least 250° F. prior to their being deposited on the conveyor.

21. A machine for cutting blanks from a web of flexible material and applying them to a substrate comprising: coacting die and anvil cylinders journalled for rotation with their axes substantially parallel to each other, at least said die cylinder having radially projecting severing elements thereon constructed and arranged to cut in cooperation with said anvil cylinder a plurality of blanks from a web of flexible material passing between the die and anvil cylinders when they are co-rotating, at least one set of a plurality of ports on said anvil cylinder and arranged to underlie a blank received thereon, at least one rotary valve having a vacuum port and a pressure port and being operably associated with said anvil cylinder so that as said anvil cylinder rotates each set of its ports is coupled sequentially in at least two circumferentially spaced zones and alternately with said vacuum port and said pressure port to at least once per complete revolution of said anvil cylinder to retain a blank thereon and release it therefrom, a transfer roller journalled for rotation on an axis generally parallel to the axis of rotation of said anvil cylinder, at least one set of a plurality of ports on said transfer roller arranged to underlie a blank received thereon, at least one rotary valve having a vacuum port and a pressure port and being operably associated with said transfer roller so that as it rotates each set of its ports is coupled sequentially in at least two circumferentially spaced zones and alternately with said vacuum port and said pressure port at least once per complete revolution of said roller to retain a blank thereon and release it while being applied by said roller to a substrate, a drive conveying a substrate closely adjacent to and by said transfer roller in synchronization therewith so that as a blank is released from said roller it is transferred and applied to a substrate, a support roller journalled for rotation on an axis substantially parallel to the axis of rotation of said transfer roller and having a rib on and projecting radially outward from said support roller and having a cylindrical outer face which underlies, bears on, has rolling contact with and supports a substrate while a blank is applied thereto by said transfer roller and said rolling contact is along a path which substantially lies in a plane containing the axes of rotation of both said transfer roller and said support roller, whereby when the die cylinder, anvil cylinder and transfer roller are co-rotating blanks are cut from the web, received on and handed off the anvil cylinder, and received on the transfer roller and released and applied to a substrate to laminate the blanks and the substrate.

22. A machine for cutting blanks from a web of flexible material and applying them to a substrate comprising: coacting die and anvil cylinders journalled for rotation with their axes substantially parallel to each other, at least said die cylinder having radially projecting severing elements thereon constructed and arranged to cut in cooperation with said anvil cylinder a plurality of blanks from a web of flexible material passing between the die and anvil cylinders when they are co-rotating, at least one set of a plurality of ports on said anvil cylinder and arranged to underlie a blank received thereon, at least one rotary valve having a vacuum port and a pressure port and being operably associated with said anvil cylinder so that as said anvil cylinder rotates each set of its ports is coupled sequentially in at least two circumferentially spaced zones and alternately with said vacuum port and said pressure port at least once per complete revolution of said anvil cylinder to retain a blank thereon and release it therefrom, a transfer roller journalled for rotation on an axis generally parallel to the axis of rotation of said anvil cylinder, at least one set of a plurality of ports on said transfer roller arranged to underlie a blank received thereon, at least one rotary valve having a vacuum port and a pressure port and being operably associated with said transfer roller so that as it rotates each set of its ports is coupled sequentially in at least two circumferentially spaced zones and alternately with said vacuum port and said pressure port at least once per complete revolution of said roller to retain a blank thereon and release it while being applied by said roller to a substrate, a heater upstream of said transfer roller and constructed and arranged to heat a substrate to an elevated temperature before the substrate passes by the transfer roller, a drive conveying a heated substrate closely adjacent to and by said transfer roller in synchronization therewith so that as a blank is normally released from said roller it is transferred and applied to a substrate, whereby when the die cylinder, anvil cylinder and transfer roller are co-rotating blanks are cut from the web, received on and handed off the anvil cylinder, and received on the transfer roller and normally released and applied to a substrate to laminate the blanks and substrate, a chute disposed adjacent said transfer roller for receiving blanks released from said transfer roller prior to being applied to a substrate, a third valve having an inlet for gas under pressure and operably connected with said rotary valve associated with said transfer roller to interrupt the normal application by said rotary valve of vacuum to a set of ports of said transfer roller and to apply gas under pressure thereto to release from said transfer roller a blank overlying said ports prior to application of such blank to a substrate so that such blank can be passed off to said chute, and a temperature detector constructed and arranged to detect the temperature of the substrate before it passes by the transfer roller and if such temperature of such substrate is less than a predetermined minimum temperature to actuate said third valve to release the blank so that is passes off to the chute and is not applied by the transfer roller to such substrate, whereby blanks are not applied to the substrate when the temperature of the substrate is less than such predetermined minimum temperature.

23. The machine of claim 22 wherein said temperature detector comprises an infrared detector and said chute comprises a conduit to which a source of vacuum can be applied to draw into the chute blanks released from the transfer roller by actuation of said third valve.

24. The machine of claim 22 wherein said chute comprises a conduit having an opening disposed adjacent said transfer roller and is constructed and arranged to be connected to a source of vacuum to draw into said chute blanks released from said transfer roller by actuation of said third valve.

25. The machine of claim 24 which also comprises an access door in said chute adjacent said opening, which is normally closed, and is opened in response to said sensor detecting a substrate having a temperature less than such minimum temperature to permit the vacuum to draw into said chute blanks released from the transfer roller by actuation of said third valve.

26. A machine for cutting membranes from a web of flexible material and applying them to a substrate comprising, a first pair of co-acting die and anvil cylinders journalled for rotation with their axes substantially parallel to each other, at least said first die cylinder having radially projecting severing elements thereon constructed and arranged to cut in cooperation with said anvil cylinder at least two strips from a web of flexible material and a plurality of longitudinally spaced apart tabs on at least one of said strips, a second pair of co-acting die and anvil cylinders journalled for rotation with their axes substantially parallel to each other and spaced downstream from said first pair of die and anvil cylinders, at least said second die cylinder having radially projecting severing elements thereon constructed and arranged to cut in cooperation with said second anvil cylinder a plurality of blanks from each strip of flexible material with the blanks cut from at least said one strip including the tab thereof when both strips of material simultaneously pass between said second die and anvil cylinders while they are co-rotating, at least one first set and one second set of a plurality of ports generally axially spaced apart on said second anvil cylinder with each set of ports arranged to underlie a blank received thereon, at least a first rotary valve and a second rotary valve each having a vacuum port and a pressure port and being operably associated with said second anvil cylinder so that as said second anvil cylinder rotates each of said first and second sets of its ports is coupled sequentially in at least two circumferentially spaced zones and alternately with said vacuum port and said pressure port at least once for each complete revolution of said second anvil cylinder to retain a membrane thereon and release it therefrom, a transfer roller journalled for rotation on an axis generally parallel to the axis of rotation of said second anvil cylinder, at least one first set and one second set of a plurality of ports generally axially spaced apart on said transfer roller and each arranged to underlie a blank received thereon, at least a third rotary valve and a fourth rotary valve each having a vacuum port and pressure port and being operably associated with said transfer roller so that as it rotates each of said first and second sets of its ports is coupled sequentially in at least two circumferentially spaced zones and alternately with said vacuum port and said pressure port, at least once for each complete revolution of said roller to retain a blank thereon and release it while being applied by said roller to a substrate, and a drive conveying substrates closely adjacent to and by said transfer roller in synchronization therewith so that as a blank is being released by said roller it is transferred and applied to a substrate, whereby when the die cylinders, anvil cylinders and transfer roller are co-rotating blanks are cut from strips of the web, received on and handed off from the second anvil cylinder, and received on the transfer roller and released and applied to substrates to laminate the blanks and the substrates.

27. The machine of claim 26 which also comprises at least one heater constructed and arranged to heat each substrate to a minimum temperature of at least 250° F. before blanks are applied to the substrates by the transfer roller.

28. The machine of claim 26 which also comprises a spreader constructed and arranged to laterally separate and space the strips after they have been severed by said first die cylinder and before blanks are cut from the strip by said second die cylinder and cooperating anvil cylinder.

29. The machine of claim 26 which also comprises a spreader disposed between said first and second die cylinders and constructed and arranged to laterally separate and space the strips after they have been severed by said first die cylinder and before blanks are cut from the strip by said second die cylinder, and a folder disposed between said spreader and said second die cylinder and constructed and arranged to fold over the tabs of at least one of said strips.

30. The machine of claim 26 which also comprises at least two resilient pads spaced apart generally axially o said transfer roller and each constructed and arranged to underlie a blank received thereon and to yieldably urge such blank onto a substrate, and each such pad having a durometer in the range of about 60 to 90.

31. The machine of claim 26 wherein said drive comprises at least one conveyor constructed and arranged to convey a plurality of substrates sequentially by said transfer roller and the machine also comprises a stacker constructed and arranged to receive a plurality of individual substrates and having a dispenser which deposits one substrate at a time onto the conveyor while it is continuously moving.

32. The machine of claim 31 which also comprises a heater constructed and arranged to heat to a temperature of at least 250° F. substrates received in the stacker prior to their being deposited on the conveyor.

33. The machine of claim 26 which also comprises at least two resilient pads generally axially spaced apart on said transfer roller and each constructed and arranged to underlie a blank received thereon and to yieldably urge such blank onto a substrate, and a surface of each resilient pad on which blanks are received having a diameter greater than the diameter of the second anvil cylinder, such that blanks received on the resilient pad are accelerated so they are transferred to a substrate at a greater lineal speed than the lineal speed of the blanks when received on the second anvil cylinder.

34. The machine of claim 26 which also comprises a chute disposed adjacent said transfer roller for receiving blanks so they will not be applied to a substrate by said transfer roller, a fifth valve having an inlet for gas under pressure and operably connected with at least one of said third and fourth rotary valves associated with said transfer roller to interrupt the normal application by such rotary valve of vacuum to a set of ports of said transfer roller and to apply gas under pressure thereto to release from said transfer roller any blank overlying such ports prior to application of such membrane to a substrate so that such membrane can be passed off to said chute, and a temperature detector constructed and arranged to detect the temperature of substrates before they pass by the transfer roller and if such temperature of a substrate is less than a predetermined minimum temperature to actuate said fifth valve to release any blank so that it passes off to the chute and is not applied by the transfer roller to such substrate, whereby blanks are not applied to substrates when the temperature of the substrates is less than such predetermined minimum temperature.

35. The machine of claim 30 which also comprises a support roller journalled for rotation on an axis substantially parallel to the axis of rotation of said transfer roller, and having a cylindrical surface which bears on, has rolling contact with, and supports a substrate while a blank is being applied thereto by said transfer roller, and said rolling contact is along a path which substantially lies in a plane containing the axes of rotation of both said transfer roller and said support roller.

36. The machine of claim 35 which also comprises a mount of said support roller which permits said support roller to move within predetermined limits generally toward and away from said transfer roller, and bias means yieldably biasing said support roller toward said transfer roller, whereby a misaligned substrate can pass between them without damaging them.

* * * * *